US007344058B2

(12) United States Patent
Bruins et al.

(10) Patent No.: US 7,344,058 B2
(45) Date of Patent: Mar. 18, 2008

(54) AUTOMATIC WASHER FEEDER FOR AUTOMATIC NAILER

(75) Inventors: Roger C. Bruins, Hudsonville, MI (US); Roger A. Vanden Berg, Jamestown, MI (US)

(73) Assignee: National Nail Corporation, Grand Rapids, MI (US)

( * ) Notice: Subject to any disclaimer, the term of this patent is extended or adjusted under 35 U.S.C. 154(b) by 49 days.

(21) Appl. No.: 11/425,399

(22) Filed: Jun. 21, 2006

(65) Prior Publication Data

US 2006/0289597 A1 Dec. 28, 2006

Related U.S. Application Data

(60) Division of application No. 10/121,627, filed on Apr. 12, 2002, now abandoned, which is a continuation of application No. 09/380,371, filed as application No. PCT/US99/02791 on Feb. 9, 1999, now abandoned.

(60) Provisional application No. 60/074,050, filed on Feb. 9, 1998.

(51) Int. Cl.
*B25C 5/00* (2006.01)

(52) U.S. Cl. ..... 227/18; 227/119; 227/136; 227/137; 227/138

(58) Field of Classification Search ..... 227/138, 227/119, 120, 15, 16, 18, 136, 137, 130, 135
See application file for complete search history.

(56) References Cited

U.S. PATENT DOCUMENTS 1,579,487 A 4/1926 Polinsky
1,615,276 A 1/1927 Hudson
2,009,580 A 7/1935 Govanus
2,385,521 A 9/1945 Mead
2,575,455 A 11/1951 Lang
2,667,639 A 2/1954 Schick
2,908,908 A 10/1959 Steinmetz et al.
2,922,162 A 1/1960 Cohn
2,968,809 A * 1/1961 Foreman et al. ..... 227/138
3,100,307 A 8/1963 Hatherell et al.
3,173,593 A 3/1965 Elliott
3,319,864 A 5/1967 Adams
3,353,737 A 11/1967 Howard et al.
3,385,498 A 5/1968 Downle
3,589,957 A 6/1971 Cohn (Continued)

*Primary Examiner*—Scott A. Smith
(74) *Attorney, Agent, or Firm*—Warner Norcross & Judd LLP

(57) ABSTRACT

An automatic washer feeder for an automatic nail gun comprises a washer storage container that stores a coil of washers interconnected together edge-to-edge and a feeding mechanism that uncoils the washers and feeds them one at a time into a position wherein the washers are in alignment with nails being driven by the nail gun. The feeding mechanism is synchronized with the nail in driver such that one washer is placed in line with each nail before it is driven. The washers are attached together edge-to-edge by a breakable linkage which is broken or cut whet a washer is driven into contact with a substrate surface being nailed by the action of the nail gun. The linkage can be an adhesive tape that breaks when the tape is pierced by a nail and the washer is driven into a substrate. Alternatively, the linkage can be formed by integrally molding the washers with an interconnecting link or by string collation.

12 Claims, 21 Drawing Sheets

U.S. PATENT DOCUMENTS 3,595,460 A 7/1971 Pitkin
3,708,062 A 1/1973 Feldhelm et al.
3,727,821 A 4/1973 Pabich et al.
3,734,377 A 5/1973 Munn
3,741,455 A 6/1973 Wandel et al.
3,796,365 A 3/1974 Downing
3,826,419 A 7/1974 Maestri
3,854,190 A 12/1974 Stark
3,854,648 A 12/1974 Inzoli et al.
3,915,367 A 10/1975 Potucek
3,930,297 A 1/1976 Potucek et al.
3,935,983 A 2/1976 Buttriss
3,945,549 A 3/1976 Colson
3,966,042 A 6/1976 Shelton et al.
3,971,421 A 7/1976 Damratowski
3,984,040 A 10/1976 Fry
4,033,499 A 7/1977 Butler
4,036,422 A 7/1977 Harvey
4,084,738 A 4/1978 Schneider
4,089,099 A 5/1978 Nivet
4,091,850 A 5/1978 Kjolsrud
4,098,171 A 7/1978 Haytayan
4,227,637 A 10/1980 Haytayan
4,246,939 A 1/1981 Boegel
4,309,787 A 1/1982 Lapohn
4,339,065 A 7/1982 Haytayan
4,346,831 A 8/1982 Haytayan
4,368,839 A * 1/1983 Okamura et al. ..... 227/91
4,581,964 A 4/1986 Takatsuru
4,630,766 A 12/1986 Steeves et al.
4,657,167 A 4/1987 Mays
4,729,164 A 3/1988 Steeves
4,732,307 A 3/1988 Hubbard et al.
4,782,989 A 11/1988 Wallin et al.
4,795,074 A 1/1989 Francis
4,817,275 A 4/1989 Van Berkel
4,824,003 A 4/1989 Almeras et al.
4,867,364 A 9/1989 Wallin et al.
4,870,570 A 9/1989 Satoh et al.
4,870,750 A 10/1989 Zahn
4,890,968 A 1/1990 Beach et al.
4,932,580 A 6/1990 Pfister et al.
4,998,662 A 3/1991 Hasan et al.
5,014,896 A 5/1991 Reitmeier et al.
5,042,142 A 8/1991 Beach et al.
5,056,684 A 10/1991 Beach et al.
5,067,865 A 11/1991 Zylka et al.
5,069,340 A 12/1991 Ernst et al.
5,105,980 A 4/1992 Hofmann
5,125,552 A 6/1992 Medwed
5,163,580 A 11/1992 Beach et al.
5,184,752 A 2/1993 Zylka et al.
5,255,485 A 10/1993 Lemke et al.
5,267,682 A 12/1993 Okouchi
5,292,048 A 3/1994 Vanderviel
5,312,022 A 5/1994 Thompson et al.
5,322,189 A 6/1994 Oda
5,327,645 A 7/1994 Bromley et al.
5,339,983 A 8/1994 Caple
5,347,707 A 9/1994 Beach
5,379,513 A 1/1995 Thompson et al.
5,402,695 A 4/1995 Hornung
5,445,297 A 8/1995 Beach et al.
5,476,204 A * 12/1995 Eisenpresser et al. ..... 227/18
5,484,094 A 1/1996 Gupta
5,555,780 A 9/1996 Beach et al.
5,570,618 A 11/1996 Habermehl et al.
5,584,415 A 12/1996 Beach et al.
5,605,269 A 2/1997 Musiani
5,634,583 A 6/1997 McGuinness et al.
5,653,372 A 8/1997 Richardson et al.
5,673,816 A 10/1997 Larson et al.
5,695,108 A 12/1997 Lee
5,706,708 A 1/1998 Refalo et al.
5,715,985 A 2/1998 Letson
5,749,508 A 5/1998 Clothier
5,934,504 A * 8/1999 Elliott ..... 221/232
5,947,362 A 9/1999 Omli
6,064,189 A 5/2000 Frankel
6,269,996 B1 8/2001 McAllister

* cited by examiner

AUTOMATIC WASHER FEEDER FOR AUTOMATIC NAILER

CROSS-REFERENCES TO RELATED APPLICATIONS

This is a divisional application of U.S. patent application Ser. No. 10/121,627, filed Apr. 12, 2002, now abandoned which is a continuation of U.S. patent application Ser. No. 09/380,871, filed Sep. 10, 1999, now abandoned, which is a National Stage of PCT Application PCT/US99/02791, filed Feb. 9, 1999, which claims the benefit of U.S. Provisional Application 60/074,050, filed Feb. 9, 1998, now abandoned.

BACKGROUND OF THE INVENTION

Automatic nailing machines are well known. Typically, in such a machine, nails joined side-by-side are stored in a magazine or nail basket. The nails are then fed into alignment with a pneumatic driver, which drives the nails when a trigger is pulled.

There are a number of applications where it is desirable to employ a washer with the nail, such as applying compressible materials, such as foam board insulation, or other tearable materials to a wall or roof. At the present time, there is no effective automatic device for automatically providing a washer to each nail as it is inserted. An object of the present invention is to provide such a device.

BRIEF SUMMARY OF THE INVENTION

In accordance with the present invention, an automatic washer feeder for an automatic nail gun comprises a washer storage container that stores a coil of washers interconnected together edge-to-edge, a feeding mechanism that uncoils the washers and feeds them one at a time into a position wherein the washers are in alignment with nails being driven by the nail gun, the feeding mechanism being synchronized with the nail gun driver such that one washer is placed in line with each nail before it is driven. The washers are attached together edge-to-edge by a breakable linkage which is broken or cut when a washer is driven into contact with a substrate surface being nailed by the action of the nail gun. The present invention can be an attachment for an existing nail gun or it can be incorporated as an integral part of the tool.

A number of features of the present invention are shown in the attached drawings and described below in connection with preferred embodiments of the present invention.

BRIEF DESCRIPTION OF THE SEVERAL VIEWS OF THE DRAWING

FIGS. 13*a* and 13*b* are perspective views of the track mechanism of the embodiment of FIG. 5, while

DETAILED DESCRIPTION OF THE INVENTION

Figure 2A:
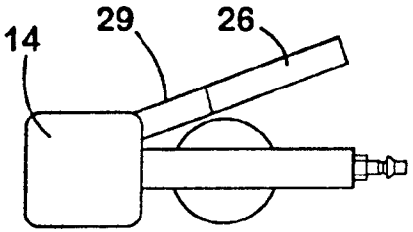
FIG. 2*a* is a plan view of the apparatus of FIG. 1.
Figure 2B:
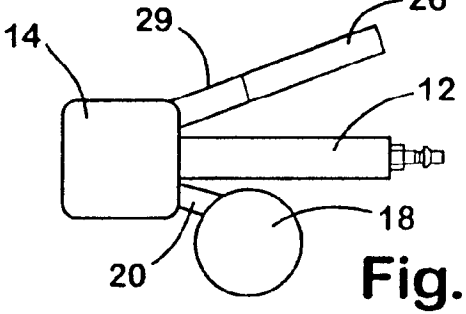
FIGS. 2*b* and 2*c* are alternative views showing different placements of the washer feeder and nail magazine of the nail gun.
Figure 2C:
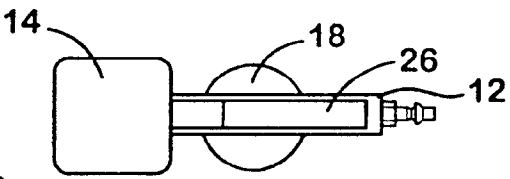
Figure 1:
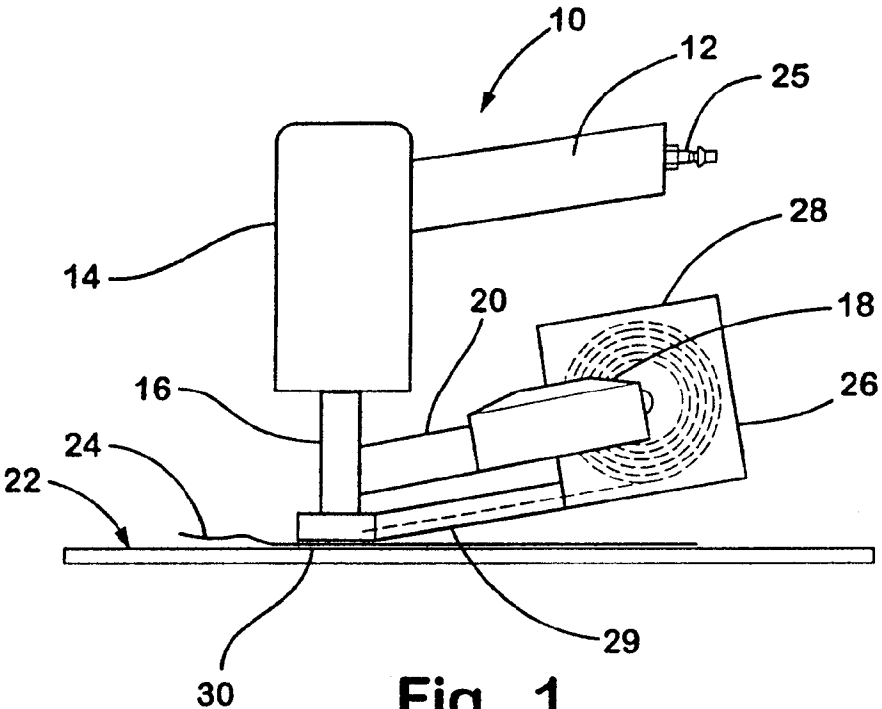
FIG. 1 is a schematic side view of an automatic nail gun employing a washer feeder of the present invention.

Referring to the drawings, a conventional nail gun 10 shown schematically in FIG. 1, comprises a handle 12, a body or housing 14 that houses a pneumatic drive cylinder and a nail driver 16 which reciprocates vertically to drive nails. Nails are stored in a nail magazine or basket 18 adjacent driver 16 and are fed through a passage or track 20 into axial alignment with driver 16. When a nail is positioned in driving position and a trigger on the gun is actuated, driver 16 reciprocates and drives a nail into a substrate 22, which may be covered by foam board insulation or roofing felt 24 or the like. Pressurized air is supplied to the gun through fitting 25.

In accordance with the present invention, a washer magazine or basket 26 positioned adjacent the nail basket 18 houses a plurality of washers on a spool or reel 28. The washers are connected edge-to-edge, and fed in a line along washer slide track 29 to a foot mechanism 30 positioned below driver 16 and nail track 20. As disclosed in more detail below, the washers are fed into alignment with nail driver 16 along with nails from the nail basket, such that when the driver is reciprocated, it first engages a nail and then causes the nail to be inserted through the washer and then drives the nail into the substrate.

Figure 4B:
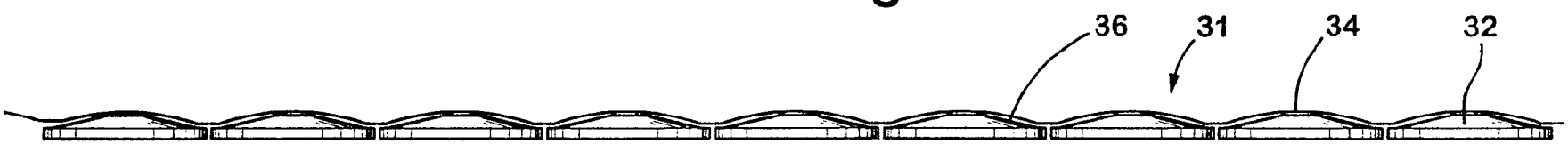
FIG. 4*b* is a side view showing a plurality of washers connected together edge-to-edge by means of an adhesive tape attached to the tops of the washers.

The manner in which the washers are fed along the washer slide track 29 is shown in FIG. 4*b*. Washers 32 are connected edge-to-edge in a strip or row 31. Desirably washers 32 are plastic washers formed of polyethylene or the like, and desirably are high density polyethylene washers sold by applicant under the trademark PLASTI-TOP. The washers preferably are connected together by means of a thin strip of adhesive tape affixed along the top sides of the washers, with the washers being separated preferably by about fifty thousandths of an inch.

The characteristics of the tape used to attach the washers together is quite important. The tape must be strong enough to allow at least a two or three pound pull on the tape without breaking so that the washers can be fed. On the other hand, the tape must either break or be separable from the washers sufficiently easily that the washers will separate when they are driven into the substrate along with a nail. A preferred tape is polypropylene tape with a natural rubber adhesive. Another tape that has been found to be satisfactory is a polyester tape coated with a silicone pressure sensitive adhesive, sold by 3M as Scotch Brand No. 8902, and known as composite bonding tape. This tape has a relatively low level of elongation before it breaks, about 120 percent. The adhesive is strong enough to adhere to metal or plastic with sufficient strength within a temperature range of 150 degrees F. to below freezing and preferably to at least as low as 20 degrees F. The tape with the natural rubber adhesive has comparable characteristics.

As shown in FIG. 4*b*, tape 34 is mounted on the tops of the washers and extends from washer to washer, with a slight separation between the washers. The tape can be perforated as shown at 36 to make the tape break more easily, but this is not necessary and provides an additional expense and complication.

Figure 3:
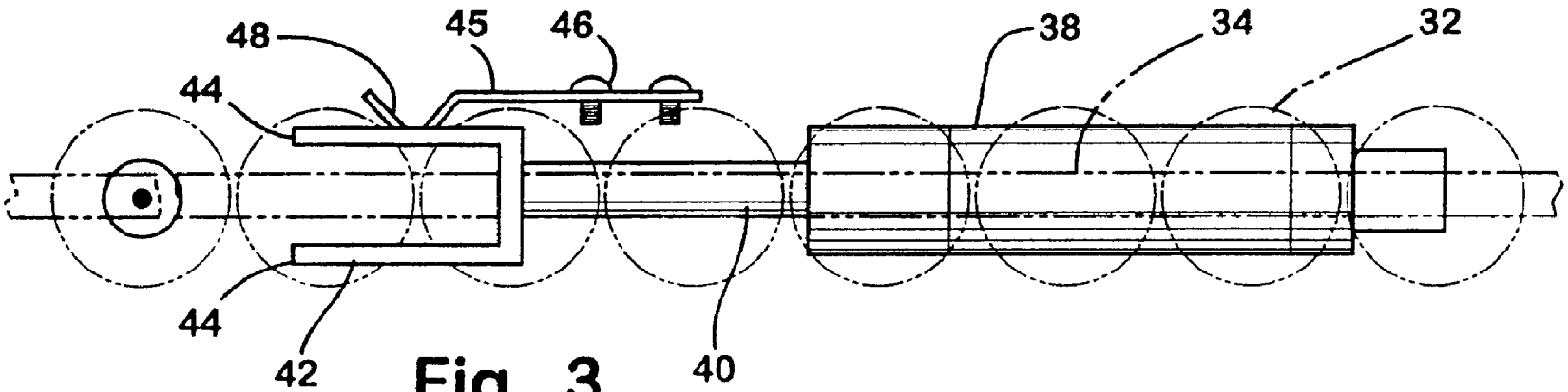
FIG. 3 is a schematic plan view showing the washer slide track and feeder of the present invention.
Figure 4A:
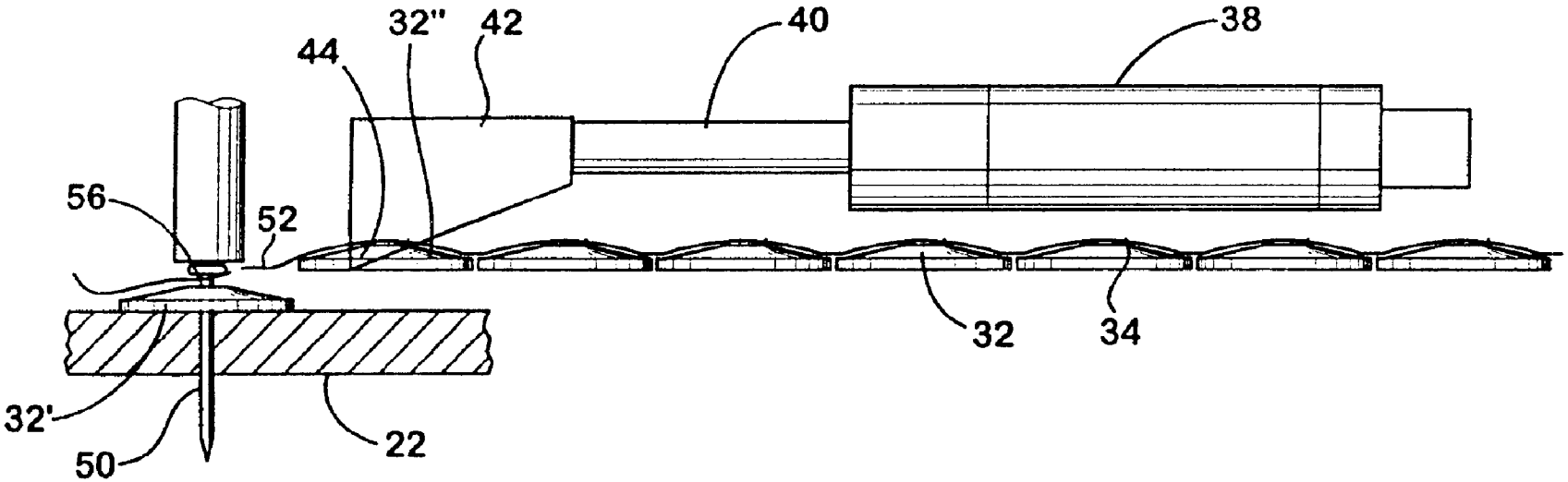
FIG. 4*a* is a side elevational view of the apparatus of FIG. 3 and also showing the nail gun driver of the invention.

The manner in which the washers are advanced one by one into alignment with the nail gun driver is shown schematically in FIGS. 3 and 4*a*. An air piston 38 positioned above the washers includes a drive shaft 40 having a washer pusher 42 mounted on the end. The washer pusher has a downwardly extending tooth 44 on at least one side of the washer pusher. In these figures, there are teeth on both sides of drive shaft 40. After a washer has been advanced into position to be nailed, the washer pusher is then retracted until the teeth fit behind the next washer. The piston is then extended once more to push the next washer into alignment with the next nail to be driven.

A washer locator 45 is positioned adjacent the sides of the washers in order to resiliently hold them in a predetermined location until they are fed into position to be driven with a nail. The washer locator 45 illustrated is a spring member mounted at one end at a fixed position by a screw 46 or the like to slide track 29. The other end of the spring includes an outwardly extending portion 48 that fits between adjacent washers and properly positions them. This spring is resiliently deflected out of the way in order to permit the washers to be pushed past the spring by means of the washer pusher.

The manner in which the washers are separated from the tape is shown schematically in FIG. 4*a*. It will be noted that when nail 50 is driven through the outermost washer 32', the washer is driven vertically downwardly from the plane of the next adjacent washer 32" in order to be driven into flush engagement with substrate 22. This does two important things. First, it peels a portion 52 of the tape away from washer 32'. Then, the downward movement of the washer places portion 52 of the tape in tension. Since the nail has already passed through the tape at location 56 on the tape, this has created a weakened portion of the tape. The tension of the tape at location 56, together with the torn and weakened condition of the tape at that location, causes the tape to rip at the hole in the tape and completely separate from washer 32". This is why it is desirable to use a tape with a low degree of elongation before the tape ruptures. A tape that stretches more would not so easily break when the nail is driven into the substrate. The fact that the tape releases from the washer by the downward movement of the washer 32' causes all of the tension force on the tape to be realized at location 56, where the nail has punched a hole in the tape. By using a tape having the characteristics described herein and by positioning the washers so that the nail gun drives the washers vertically out of the plane of the next adjacent washer, the washers can be fastened together firmly with a tape and yet will automatically separate whenever the washers are attached with a nail to a substrate material.

The fact that the tape is affixed to the tops of the washers is also important. When the tape is affixed to the tops of the washers and the washers are separated slightly, the washers can then be wound on a reel or spool with the tape on top of the washers. This provides a substantially more compact method of storing the washers than attachment of the tape to the undersides of the washers.

In order to permit the washers to be wound in a coil with the tape attached to the tops of the washers, it is necessary to space the edges of adjacent washers apart so that the desired arcuate contour can be obtained without the edges of the washers coming into engagement and interfering with the inward bending of the washer strip. The washers are desirably separated by about forty to sixty-two thousandths of an inch and preferably about fifty thousandths of an inch.

Desirably, the washers are wound on spools or reels formed of cardboard or other suitable material, which are then mounted into a basket or reel holder 26. In the present invention, the spool is sufficiently large to hold approximately 350 washers. This is desirable because a conventional nail basket holds about 350 nails, so the user can replenish the supply of nails and washers at approximately the same time.

A feature of the present invention is to attach the washers together with the pressure sensitive adhesive tape described above and to mount the tape as described. This provides an effective and inexpensive way of attaching the washers together. However, there are other ways to attach washers together that functionally can be satisfactory. These include molding or otherwise forming the washers with their edges joined together edge-to-edge; molding the washers side-by-side with a string, such as a nylon fishing line, extending though the mold cavity and being integrally molded into the washers (called "string collation"); melting the washers together so that they are attached edge-to-edge; gluing or bonding the washers together edge-to-edge; and attaching the washers with mechanical tabs, such as a tab on one washer that fits a recess in another washer.

Figure 34:
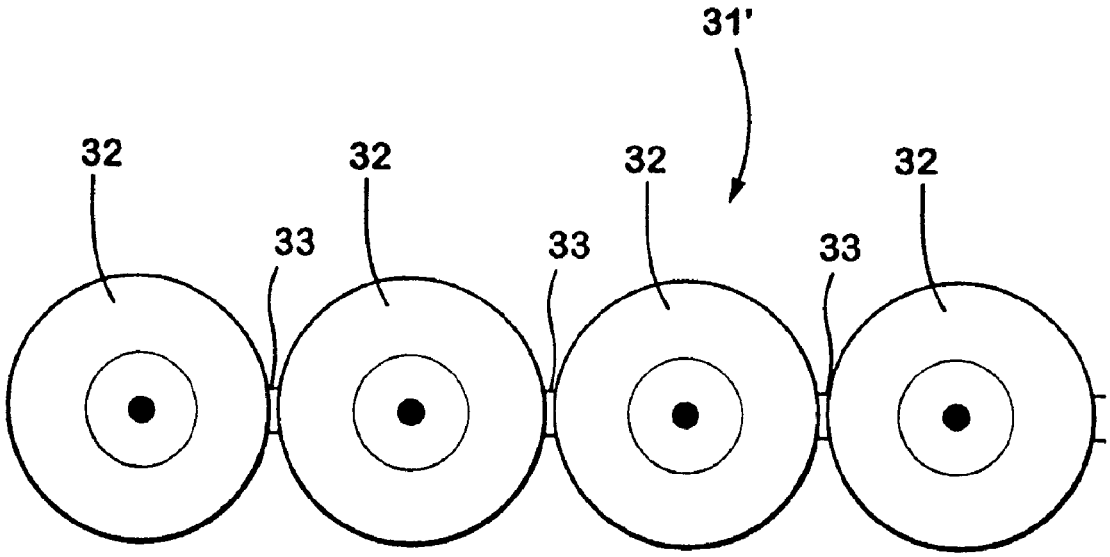
FIG. 34 is a plan view showing an integrally molded strip of washers.

The present tape method may provide some cost advantage over other attachment methods, but other methods will work. An integrally molded washer strip 31' is shown in FIG. 34. In the embodiment, the washers are integrally molded in a strip or web, with an integral connector 33 between each pair of washers 32. Washer separation is only required to the extent necessary to permit the strip to be coiled and to provide a connection that will break or can be cut to separate the washers during installation. A cutter can be coordinated with the nail driver if the connector does not break easily enough when the washer is applied to a substrate.

Figure 35:
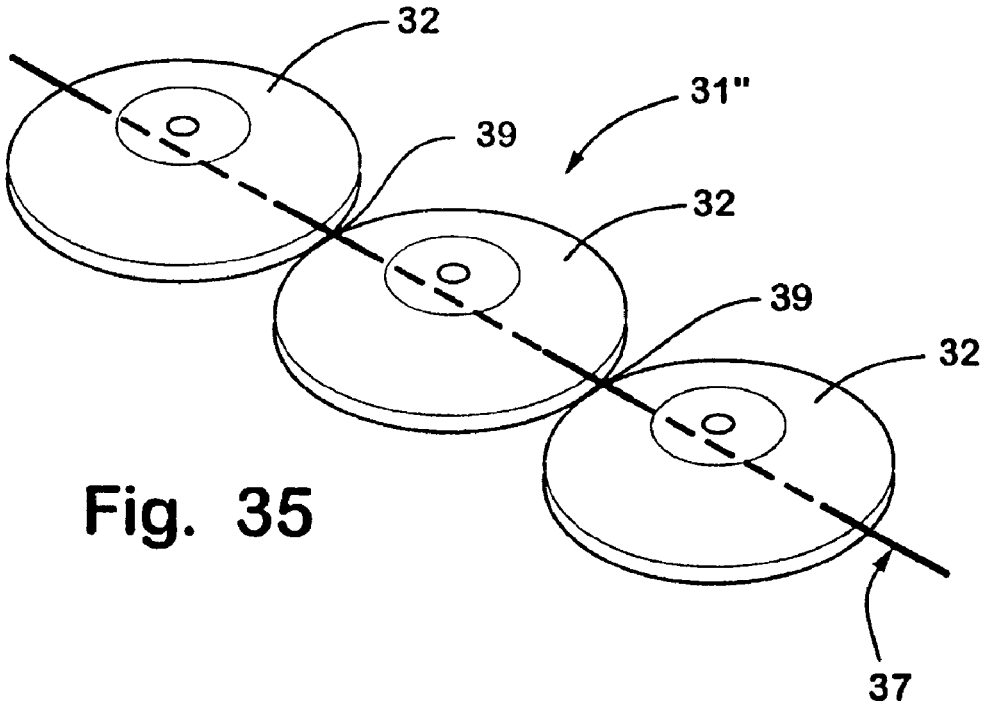
FIG. 35 is a perspective view showing string collated washers.

A washer strip 31" wherein individual washers are attached together by a nylon or string or other plastic filament 37 is shown in FIG. 35. With this type of connection (which is a known process for collating parts, called "string collation") washers are molded side by side in adjacent die cavities in a mold and a filament like fishing line is placed in the mold so it extends through the cavities. When resin is injected into the cavities, the string is integrally molded into the washers, and the washers are connected together by the portion 39 of the string that runs between the cavities. These washers can be dispensed from a reel like the other washers, with the string being broken or cut as each washer is applied with a nail to a substrate.

While molded washers are contemplated in FIGS. 34 and 35, it is possible that integrally connected washers can be produced by other methods, such as by vacuum forming or die cutting, wherein a strip of plastic sheet material is cut and shaped so as to leave a thin web of material between the washers. The present invention is not intended to be restricted to any one particular method for forming interconnected washers.

Figure 5:
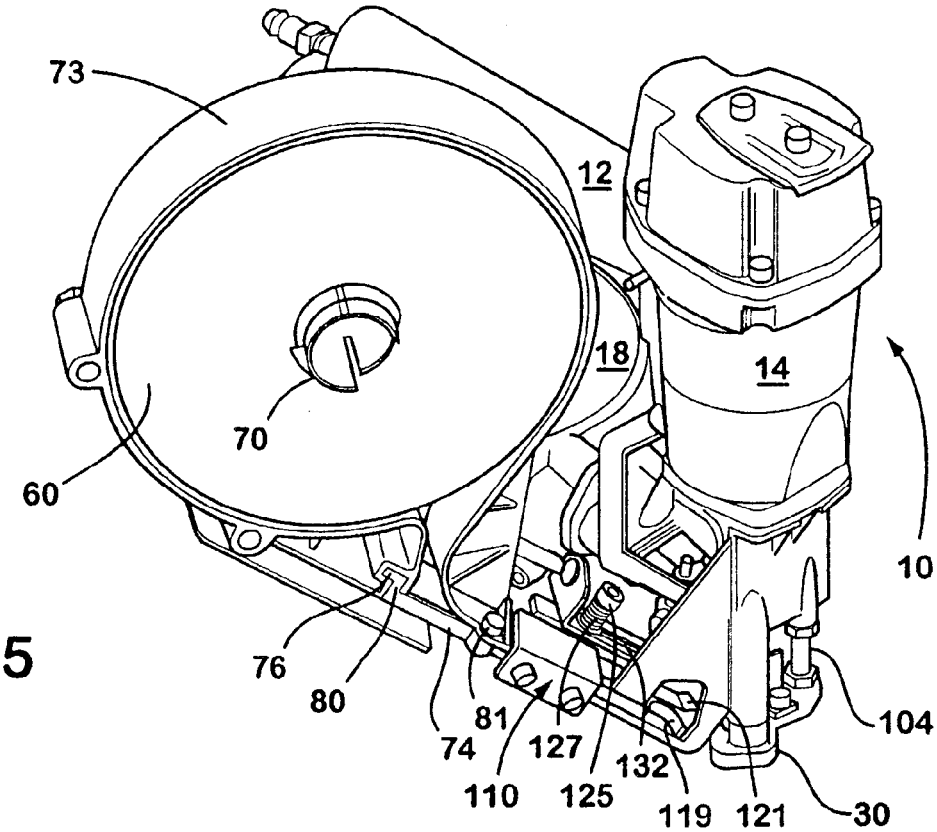
FIG. 5 is a perspective view taken from the upper right side a first embodiment of the present invention.
Figure 6:
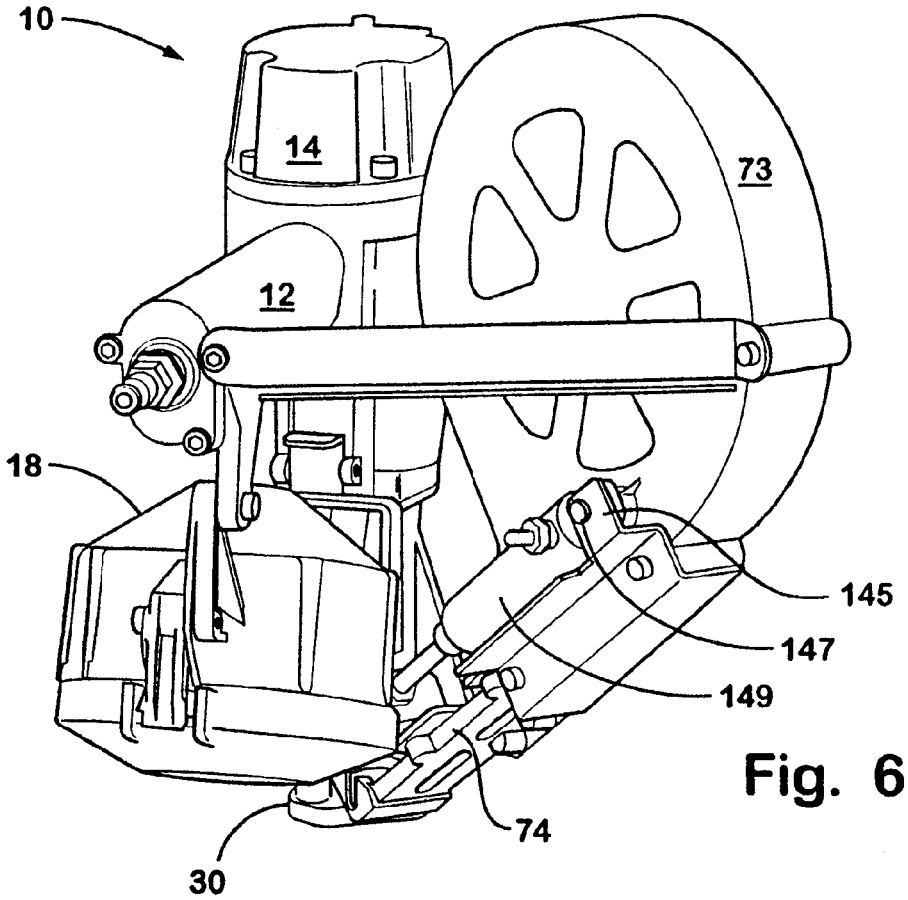
FIG. 6 is a perspective view taken from the rear of the embodiment of FIG. 5.
Figure 7:
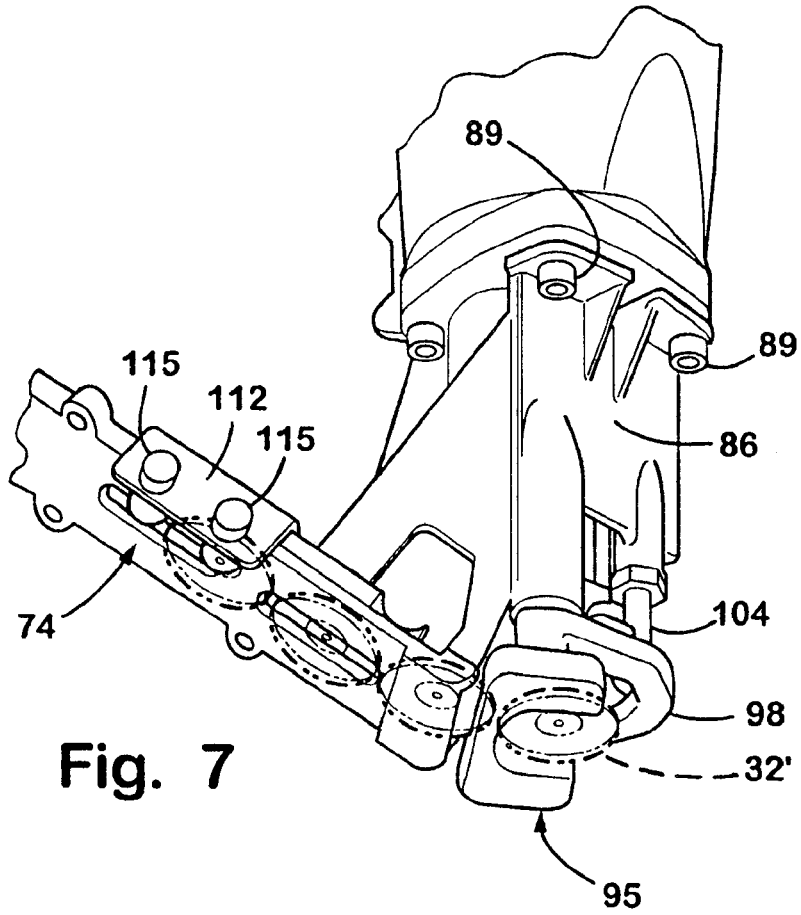
FIG. 7 is a fragmentary perspective view taken of the lower left side of the washer slider track and nail driver of the embodiment of FIG. 5.
Figure 8:
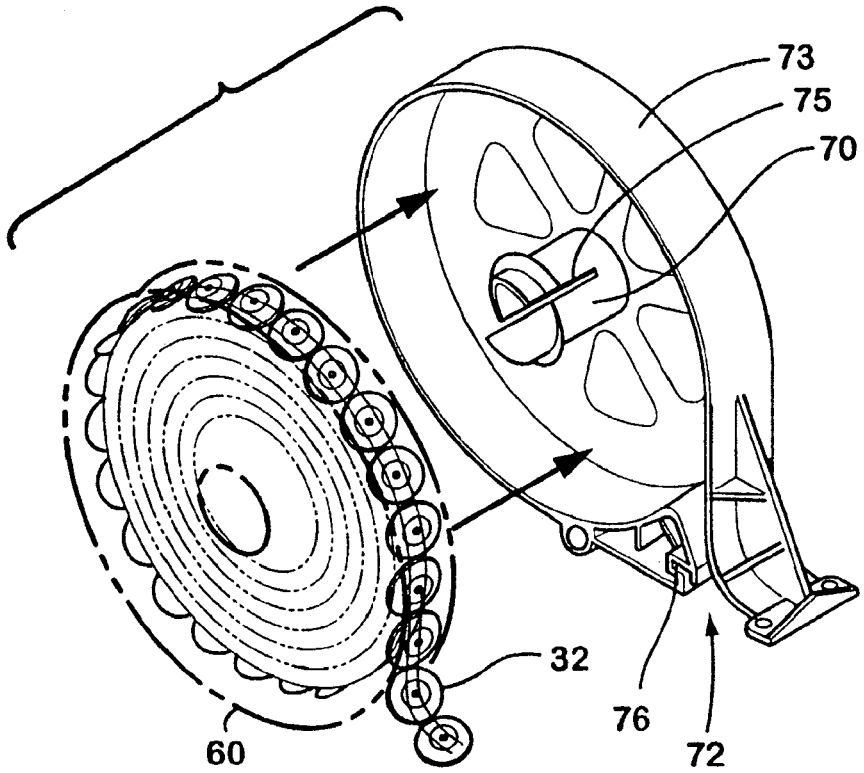
FIG. 8 is a perspective view of a reel of washers and a reel holder of the present invention.

One embodiment of the invention is shown in more detail in assembled form in FIGS. 5-7, and the detailed drawings of the components thereof are shown in FIGS. 8-14*c*. As shown in FIG. 8, the washer holder comprises a round housing 73 having an open interior and an open side in which a spool 60 of washers is inserted. The housing has a spindle 70 that holds the spool (which alternatively is called a reel). This spindle is formed of a hollow, resilient material and has a slot 75 in the side, so that the spool can be clipped on the spindle and then removed from the spindle by squeezing the sides of the spindle together. The washers are wrapped on the spool so that the spool is rotated in a clockwise direction (FIG. 8 orientation) in order to remove washers from the top of the spool from an outlet passage 72.

A washer slide track 74 (FIGS. 13*a-d*) clips in an L-shaped opening 76 behind outlet opening 72 in the washer holder and is held in place by fasteners 81 (FIG. 5). Slide track 74, shown in detail in FIGS. 13*a*-13*d*, comprises an elongated flat track 78 with raised side edges 79. An L-shaped connector 80 at an upper end of the track mates with opening 76 in the washer holder. The track has openings 82 in the bottom thereof which permit manual access to the washers in the track in the event of malfunction or the like. An outlet end 84 of the track discharges washers at a position adjacent the nail driver. A mounting flange 86 attaches to the housing 14 of the nail gun by bolts 89 that extend through openings 87. The flange positions the track in proper position. Tubular members 88 and 90 at the outer ends of the track are positioned to be slidably attached to a foot mechanism 95 as shown in FIGS. 12*a-c*.

Foot mechanism 95 comprises a lower member 96 and an upper bar 98 which together encircle an open center area 101 through which nails are driven. The foot has spaced vertical openings 100 extending downwardly from the upper side of the foot. A pair of pins 97 and 99 fit snugly in the openings and slide up and down in mating openings in the tubular members 88 and 90 on the track, which serves as a bearing guide. Bar 98 engages a movable safety bracket 104 (see FIG. 5) when the foot is slid upwardly to its uppermost position. When the nail gun is placed against a substrate, and pressed downwardly, foot 30 slides upwardly. This causes bar 98 to engage and move safety bracket 104 upwardly in tubular bearing guide 105 until it actuates a safety valve (not shown) that activates the nail gun. Then, when the trigger is pulled, the piston drives a nail downwardly into the substrate. The safety valve is conventional. It ensures that a nail cannot be driven until the foot of the gun is safely positioned against a substrate.

As shown in FIG. 7, the bottom side of a foot member 95 is positioned so that when the foot is raised to an activated position, the bottom of the foot is about 1/8 to 7/16 inches and preferably about 5/16 inches below the bottom surface of washer 32'. Thus, when the nail driver drives the nail through the washer and drives the nail into the substrate, the washer is displaced vertically before it contacts the substrate. As stated above, this causes the tape to peel off one side of the washer and permits the tape to break free from the washer at the nail.

Figure 9:
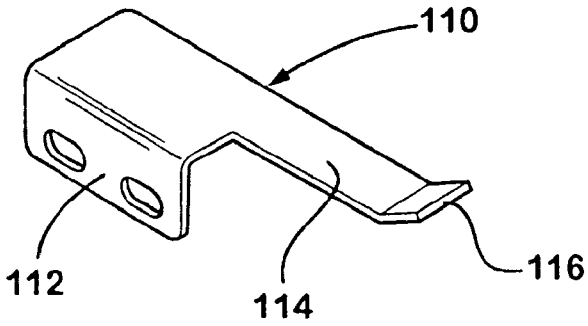
FIG. 9 is a perspective view of the washer retainer of the embodiment of FIG. 5.
Figure 10:
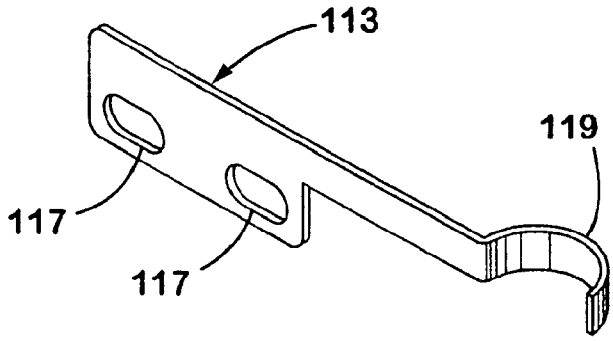
FIG. 10 is a perspective view of the spring washer locator of the embodiment of FIG. 5.

A washer retainer 110, shown in FIG. 9, is mounted on track 74 by a mounting flange 112. An elongated arm 114 having an upwardly tilted front end 116 is positioned over the washers in the track to hold the washers down as they move along the track. The upwardly inclined front end permits the washer path to change from an initially inclined path to a horizontal path as the washers enter the foot assembly.

The washer feed mechanism of this embodiment also includes a washer locator in the form of an indexing spring 113 that is attached to the side plate 112 of retainer 110 by screws 115 or the like that extend through slotted openings in the side plate and into the side of the slide track (see FIG. 7). The spring retainer (FIG. 10) has slotted openings 117 that permit longitudinal adjustment of the spring retainer. The spring retainer has a looped head 119 that fits through an opening 121 in the bracket 86 for the slide track and into engagement between adjacent washers in order to hold the washers in position. The spring retainer is deflected out of the way in order to permit the washers to be pushed into alignment with the nail driver.

Figure 11:
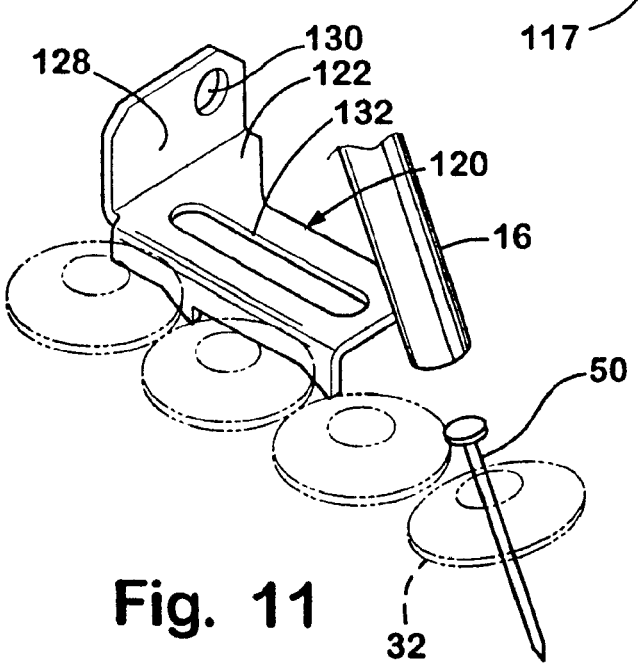
FIG. 11 is a perspective view of the washer pusher of the embodiment of FIG. 5.
Figure 12:
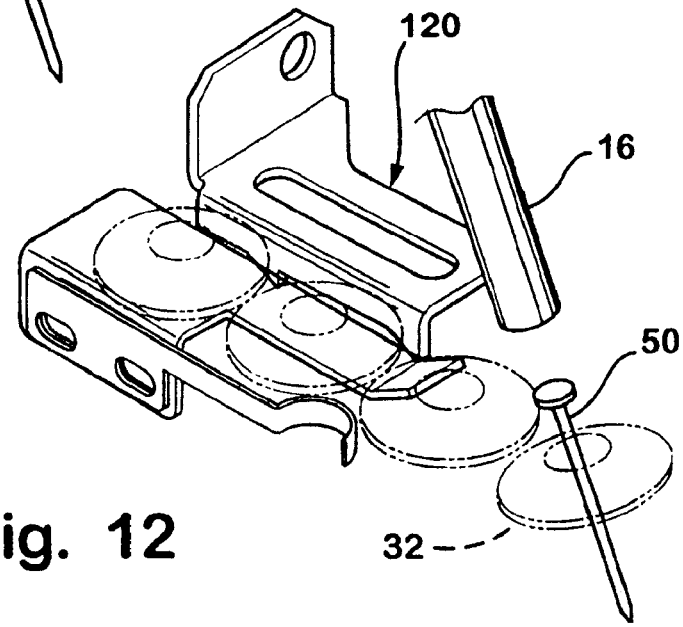
FIG. 12 is a perspective view showing the washer pusher as in FIG. 11 and the retainer and washer locator elements of FIGS. 9 and 10.
Figure 13A:
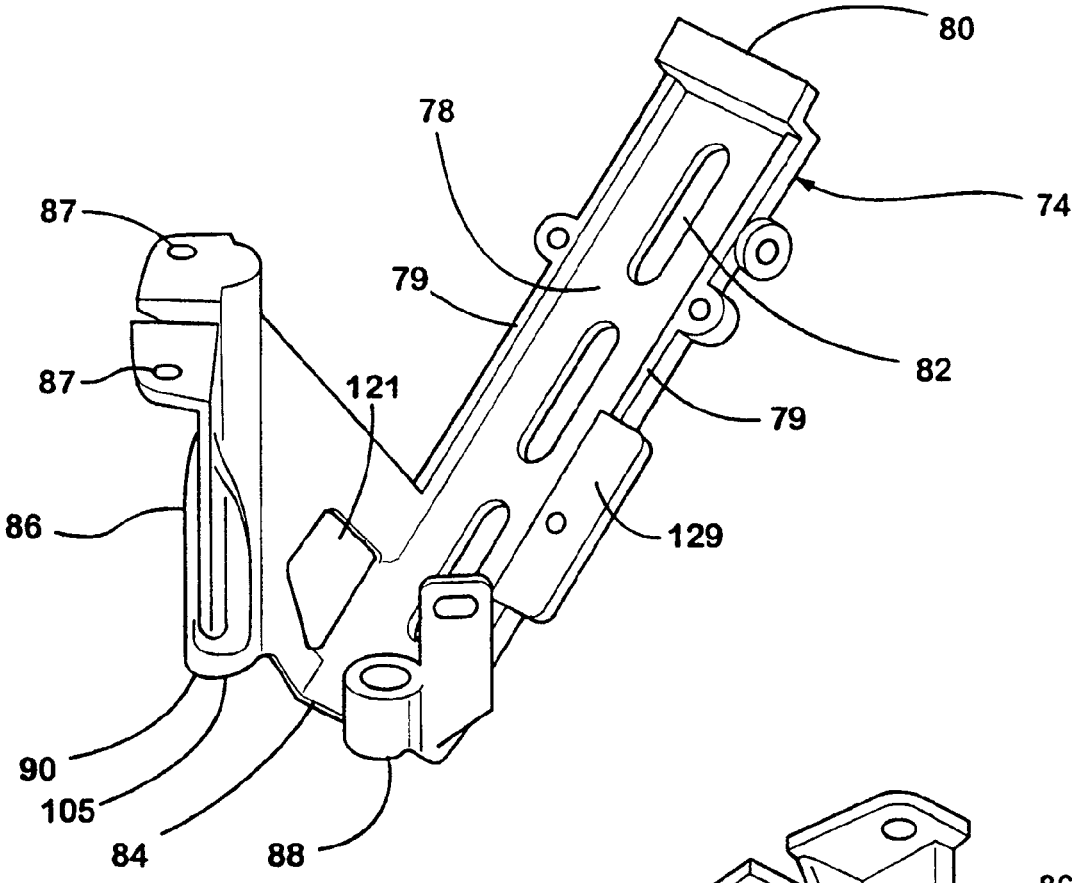
Figure 13B:
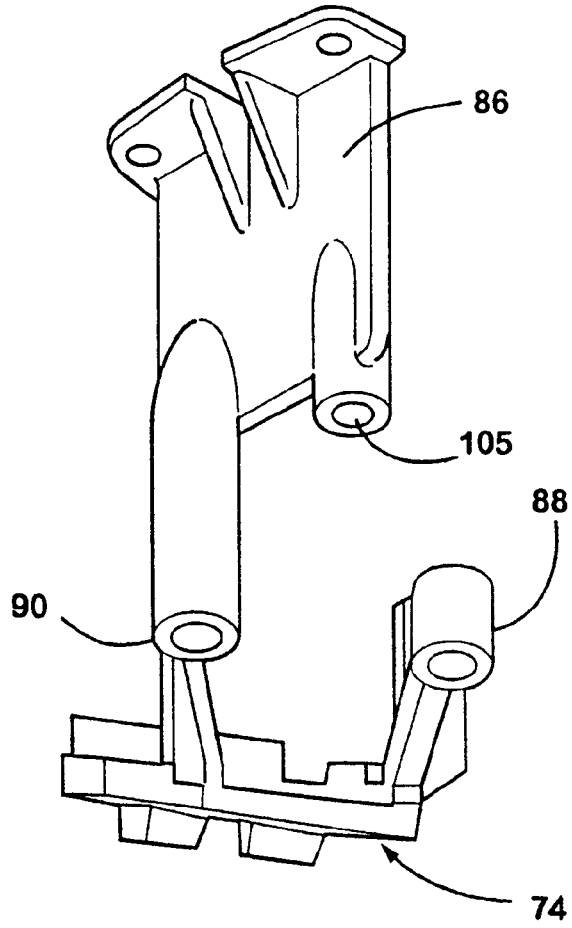
Figure 13C:
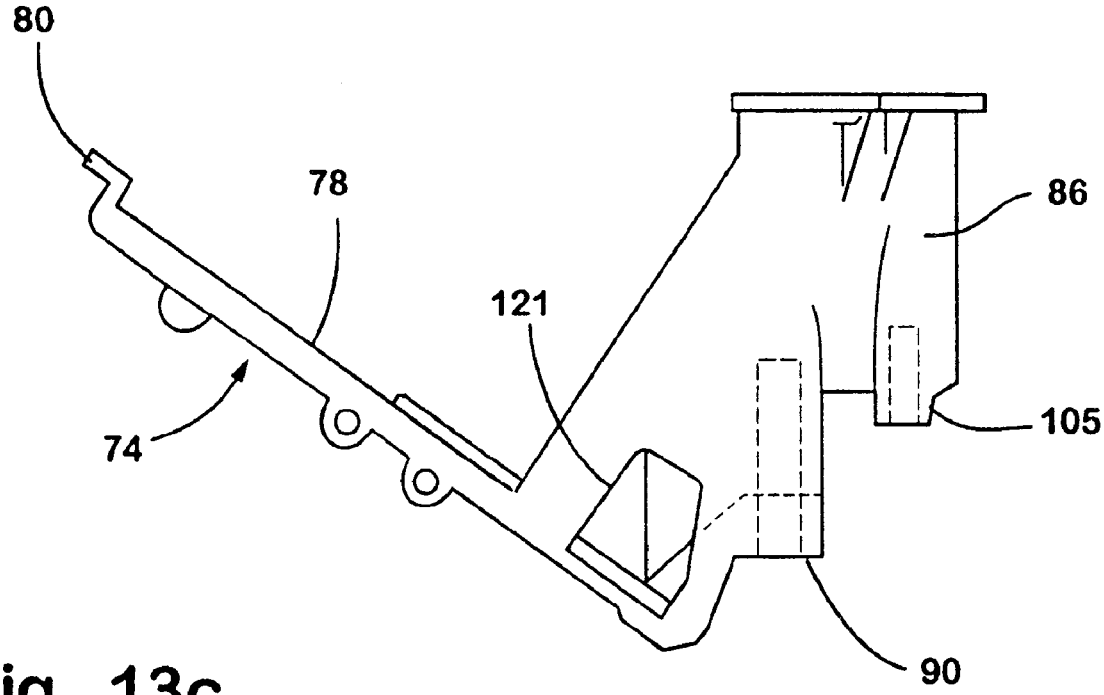
FIG. 13*c* is a side elevational view of the track mechanism and FIG. 13*d* is a plan view of the track mechanism.
Figure 13D:
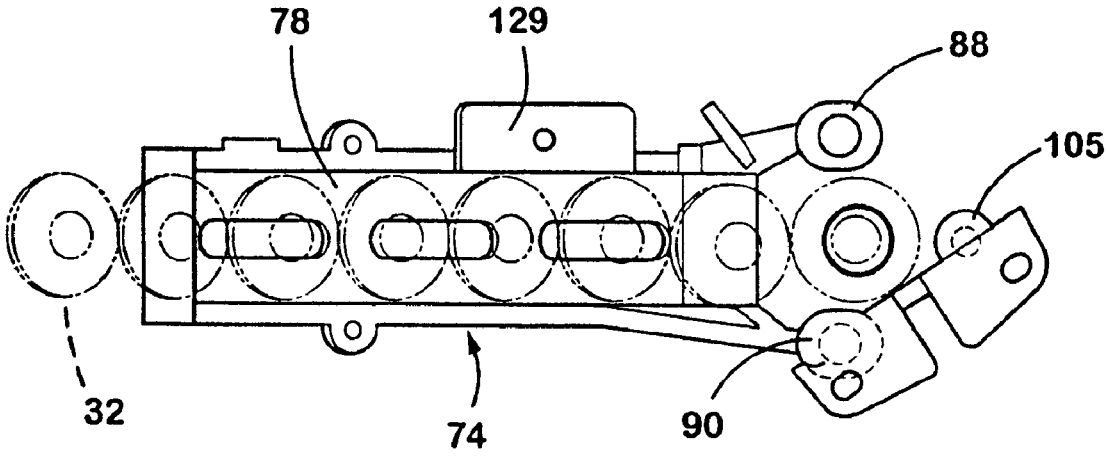
Figure 14A:
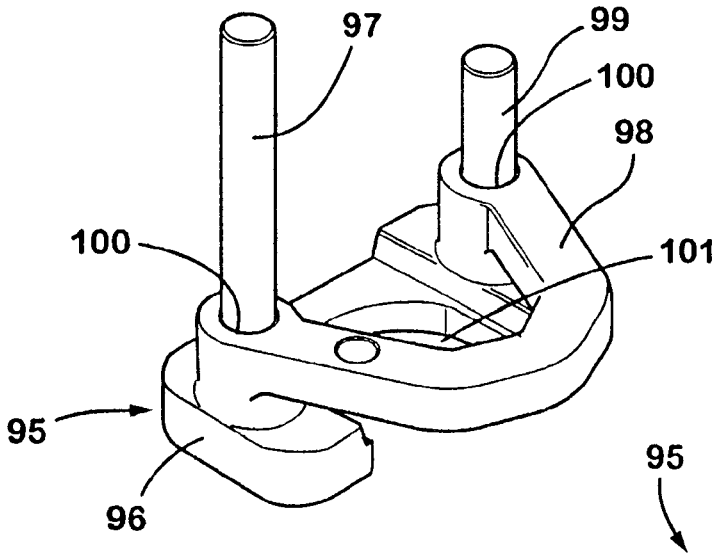
FIGS. 14*a* through 14*c* are a perspective view, plan view, and rear elevational view of the foot mechanism of the embodiment of FIG. 5, showing the foot mechanism with guide pins mounted therein.
Figure 14C:
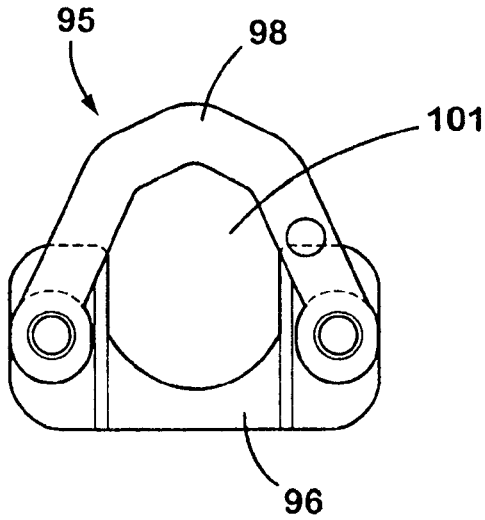
Figure 14B:
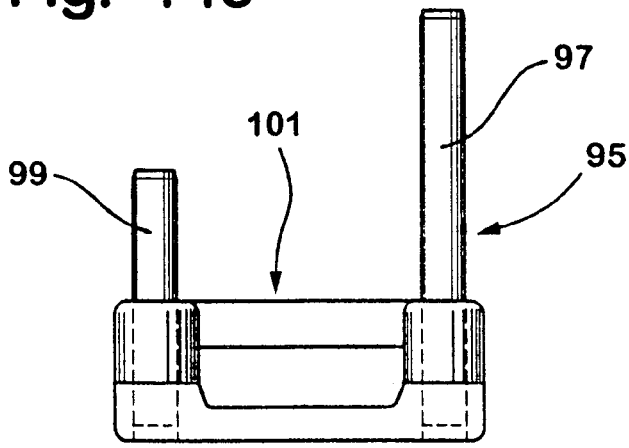

The details of the washer pusher 120 employed in the embodiment of FIGS. 5-8 are shown in FIG. 11. Washer pusher 120 comprises a plate 122 having longitudinally spaced, downwardly extending teeth 124 and 126 along one side thereof. Each of these teeth engages one washer. Thus, the washer pusher pushes two washers at once. This minimizes the stress on the tape attached to any one washer. The teeth have vertical edges on a front side and beveled edges on a rear side. The beveled edges serve as cam surfaces and permit the teeth to ride over the washers when the washer pusher is retracted. An upwardly extending flange 128 includes an opening 130 therein in which the drive shaft 141 of piston 143 is attached. A slot 132 is formed in plate 122. A resilient attachment mechanism holds the plate downwardly on the track while the plate is permitted to slide longitudinally along the track in order to push the washers into driving position. The attachment mechanism comprises a bolt 125 that fits through slot 132 and screws into a flange 129 on the side of the track, with a spring 127 positioned between the head of the bolt and plate 122 resiliently holding the plate down (see FIG. 5). Thus, when the washer pusher is retracted, the spring lets the teeth of the washer pusher move upwardly and over the washers.

As shown in FIG. 7, the drive cylinder 149 for the washer pusher 120 is mounted on a vertical flange 145 by means of a trunion mount. A bolt or shaft 147 extends through an opening in a fitting at the rear of the drive cylinder and permits the drive cylinder to rotate about the bolt. Thus, when the washer pusher rocks upwardly as the washer pusher is retracted, the drive cylinder can pivot upwardly to accommodate the upward pivotal movement of the washer pusher.

Figure 15:
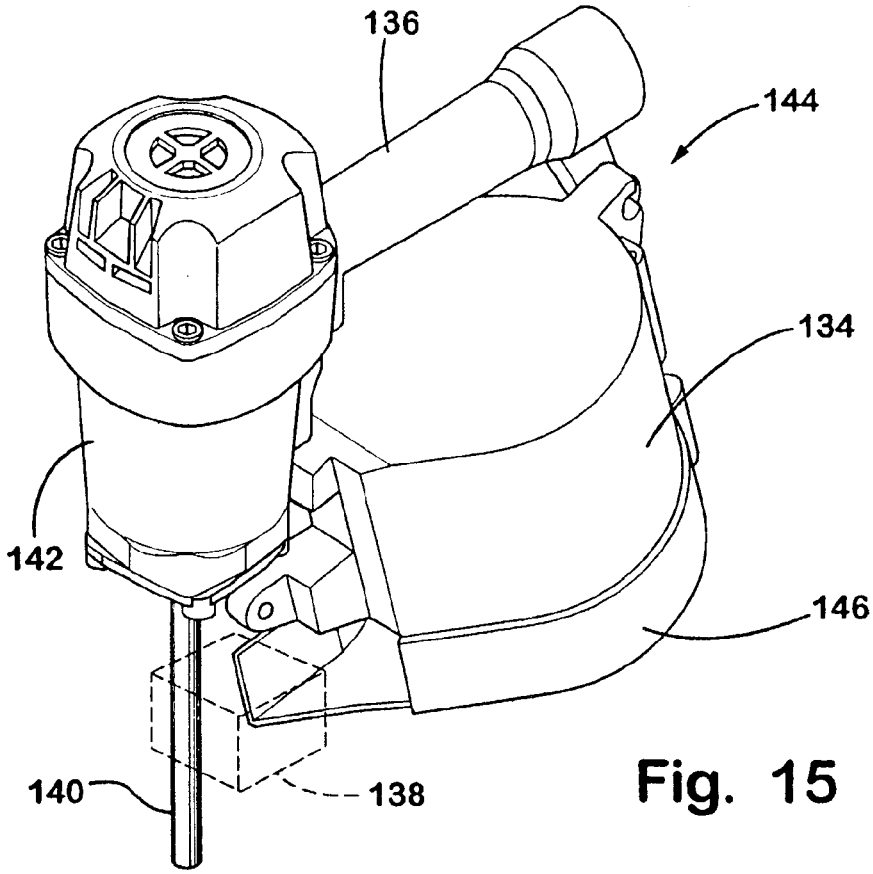
FIG. 15 is a perspective view of a second embodiment of a present invention.
Figure 16:
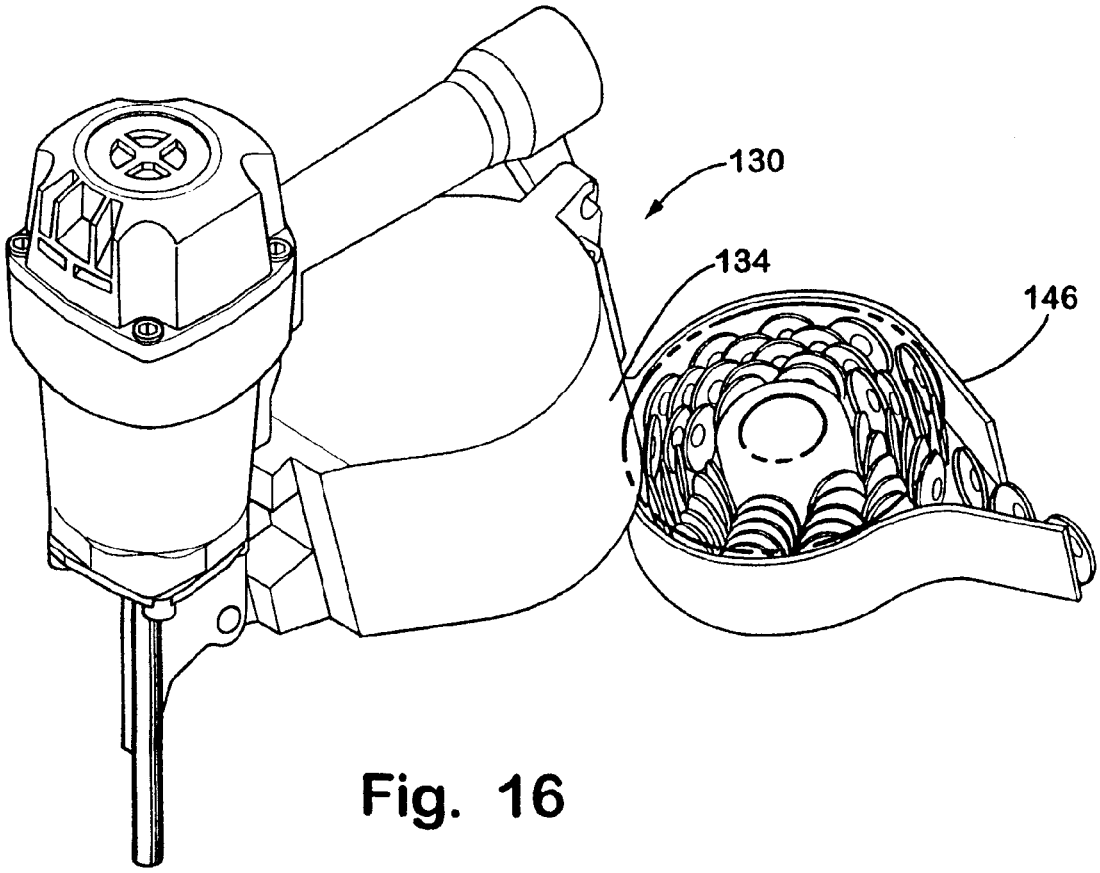
FIG. 16 is a view of the embodiment of FIG. 15 with the washer magazine in an open position.

An alternative embodiment 144 of the present invention is shown in FIGS. 15 and 16. In this embodiment, the storage container or magazine 146 for the washers is oriented horizontally and mounted in line with and directly below the nail magazine 134, which is in turn directly below handle 136. With all of these members being in line, there is no twisting force on the handle when the handle is being held. As shown in FIG. 16, the magazine 146 pivots outwardly on a hinge to provide access to the interior of the magazine for the purpose of reloading washers. In FIG. 16, the washers are shown mounted loosely in a coil and inserted directly in the magazine as opposed to being mounted on a spool. The washers could, however, be on a spool of the type described above and this is the preferred construction. Alternatively, the magazine could be removable and could be the container in which the washers are packaged. In the embodiment of FIGS. 15 and 16, the washers are oriented vertically, transverse to the horizontal position that they have to be in to engage a nail properly. An orienting device 138, shown schematically in FIG. 15, is necessary to reorient the washers into a horizontal plane as they move into position below driver 140, which is operated by drive cylinder 142.

While the present invention is particularly suitable for automatically inserting plastic washers on nails as they are driven into a substrate, it is contemplated that the present invention also can be used to insert nails in metal washers. In such a case, either a light weight, pierceable metal washer is used or it is necessary to provide an accurate aligning mechanism so that the nail accurately hits the hole in the metal washer. Another way of inserting a nail in a metal washer is to provide a means to first set the tip of the nail in the washer without applying the full driving force of the driver to the nail. Once the nail is set, the driver can be applied with full force to drive the nail into the substrate.

Another, and preferred embodiment of the present invention is shown in FIGS. 17-33. Parts that are the same as in prior embodiments are identified by the same number. Washer feeder and gun assembly 150 comprises the same conventional nail gun 10 as in the embodiment of FIGS. 5 and 6. In this embodiment, however, the washer magazine or basket 152 receives a spool or reel of washers through an opening 154 in a rear edge thereof, and the interior of the washer magazine (also called a reel holder) contains no spindle on which the reel is mounted. Instead, the reel rides freely in a cylindrical opening in the interior of the reel holder.

Figure 17:
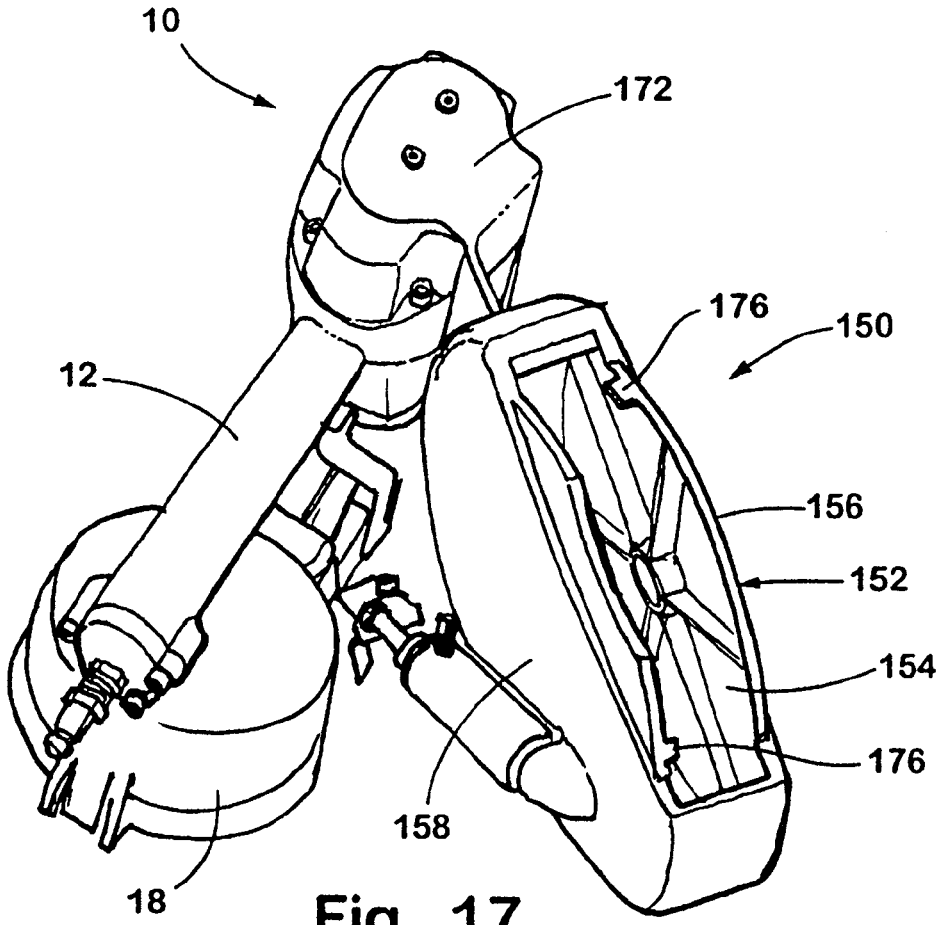
FIG. 17 is a rear perspective view of a third embodiment of the present invention.
Figure 18:
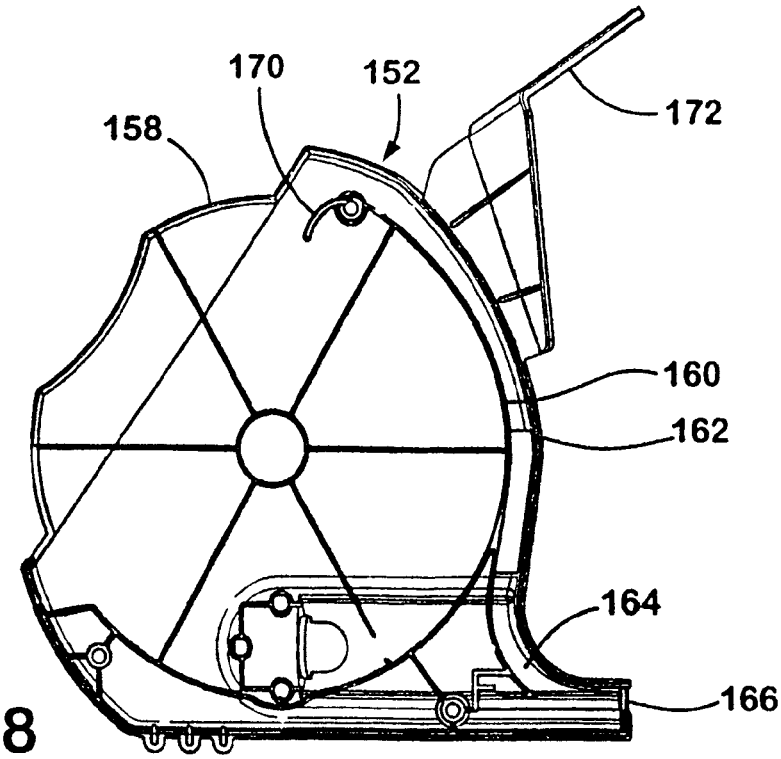
FIG. 18 is a side elevational interior view of the reel holder of FIG. 17.
Figure 19:
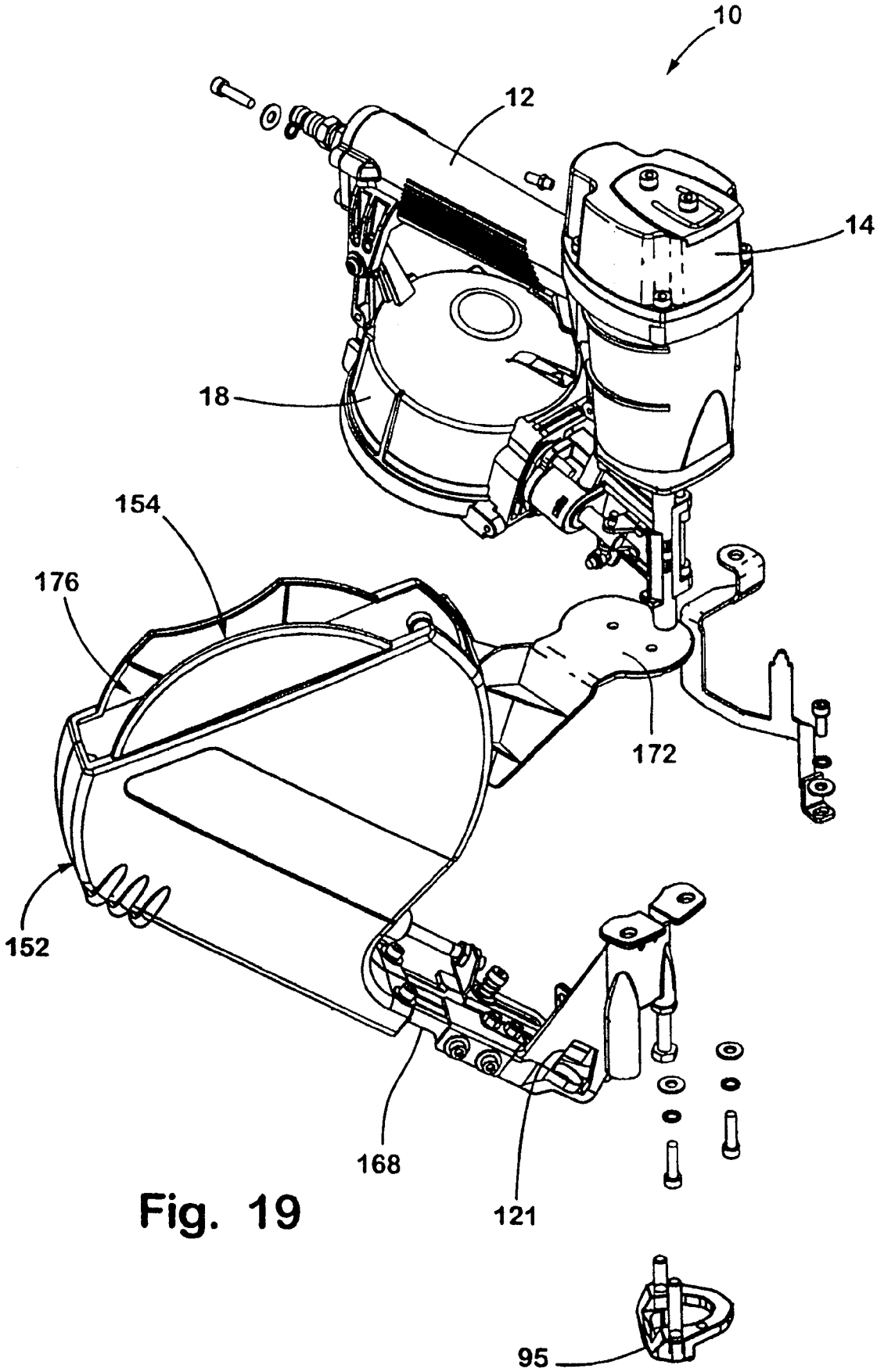
FIG. 19 is an exploded view of the components of the embodiment of FIG. 17.
Figure 20:
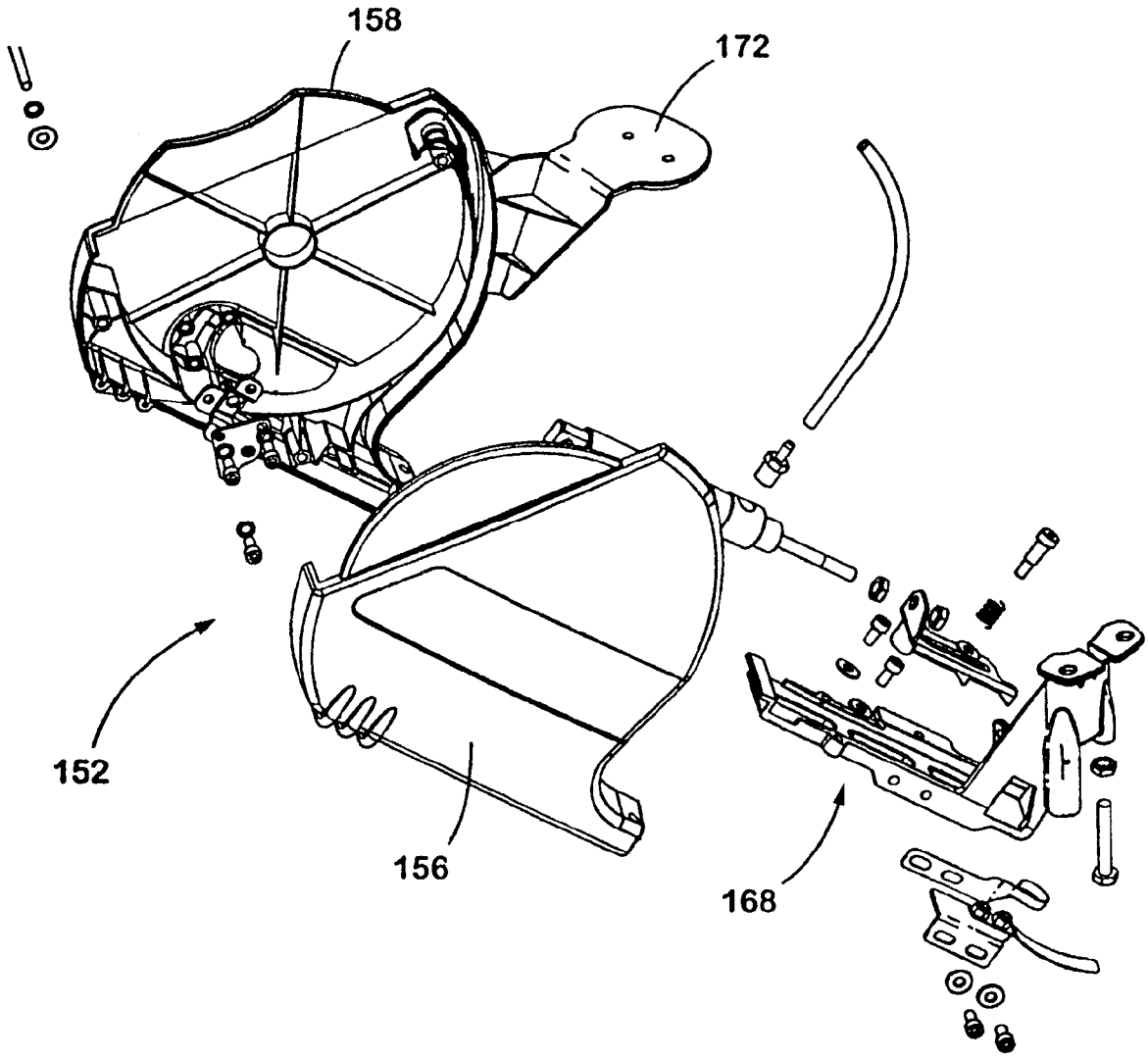
FIG. 20 is an exploded view of the washer feed mechanism of the embodiment of FIG. 17, showing the washer reel holder and the track mechanism.
Figure 21:
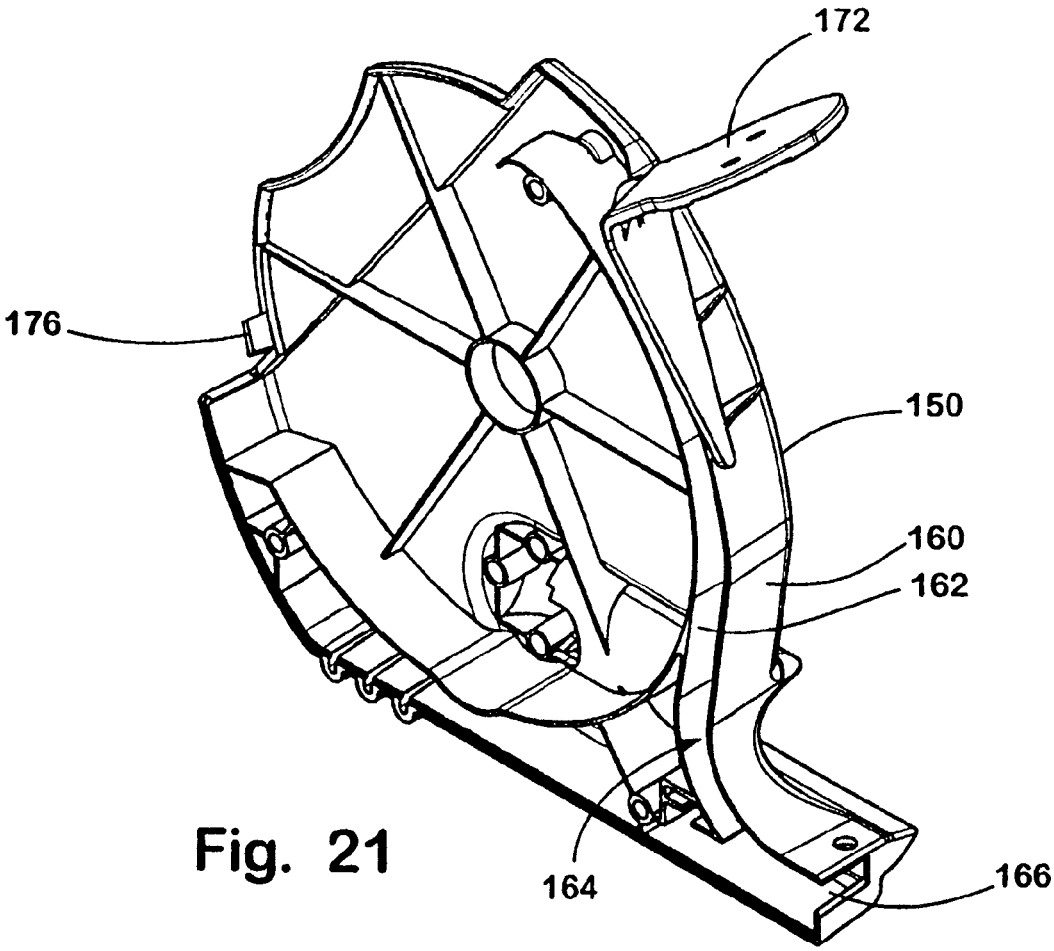
FIG. 21 is a perspective view of the interior of one side of the reel holder of FIG. 17.
Figure 22:
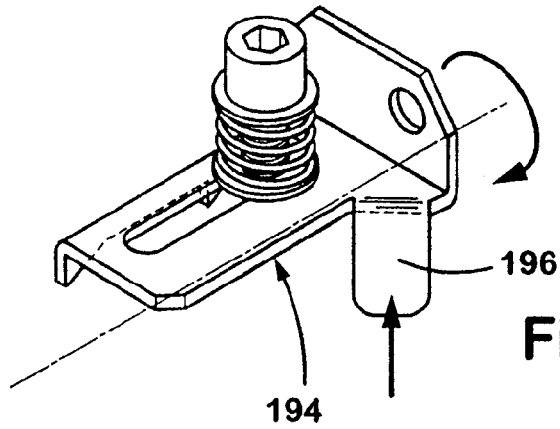
FIG. 22 is a fragmentary perspective view of the washer pusher of the embodiment of FIG. 17 as it is mounted on the slide track mechanism.
Figure 23:
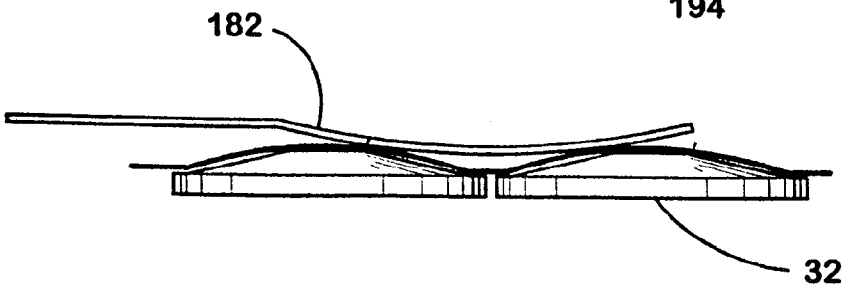
FIG. 23 is a side elevational view showing the engagement between the retainer spring of FIG. 24 and the upper surface of the washers passing thereunder.
Figure 24:
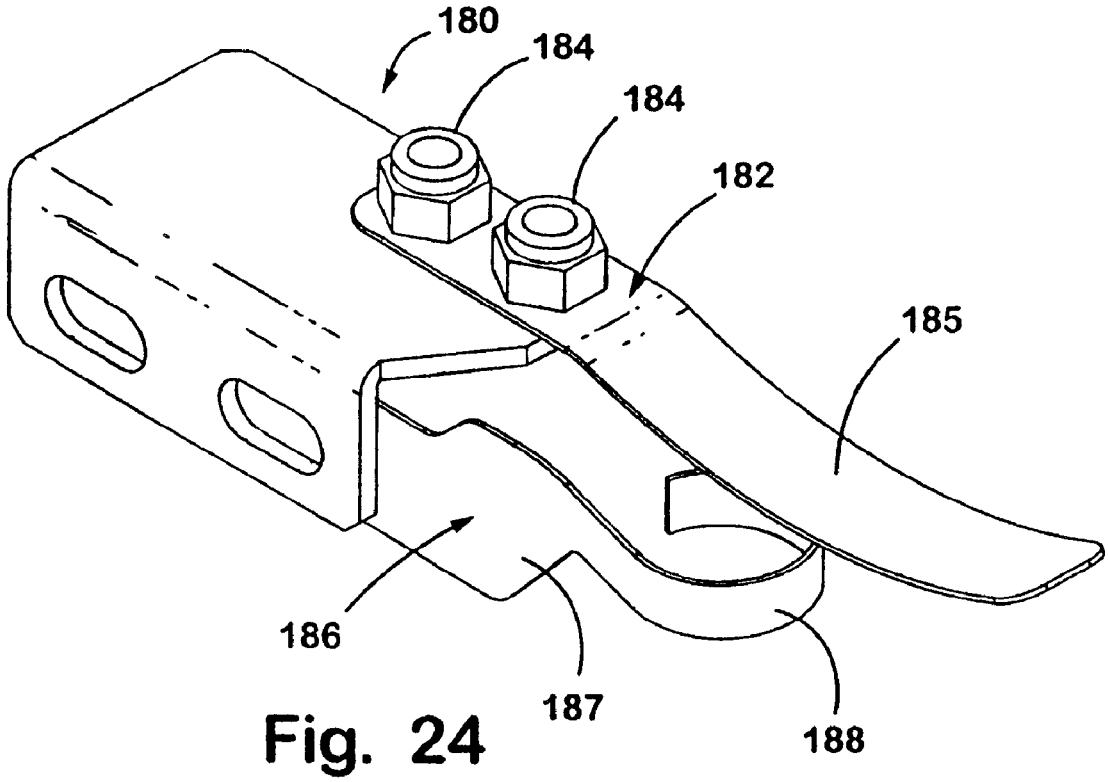
FIG. 24 is a perspective view of the retainer and washer locator mechanisms of the embodiment of FIG. 17.
Figure 25B:
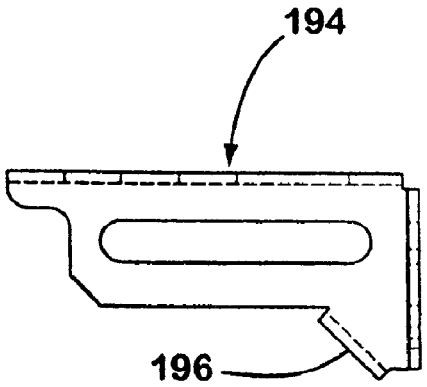
FIGS. 25*a* through 25*d* are a perspective view and left side, right side, and front elevational views of the washer pusher mechanism of FIG. 17.
Figure 25A:
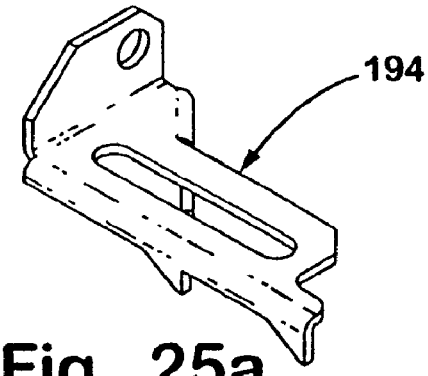
Figure 25C:
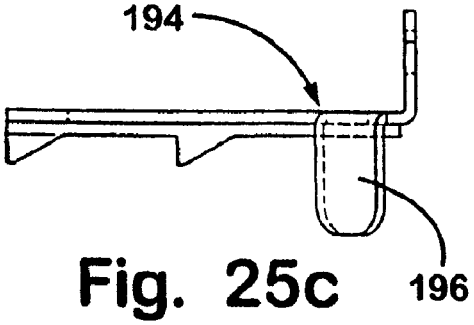
Figure 25D:
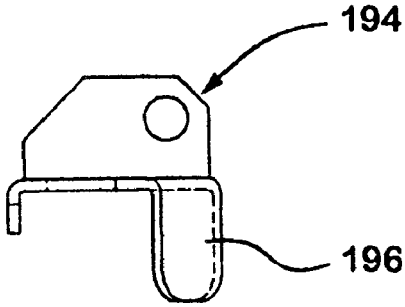
Figure 26A:
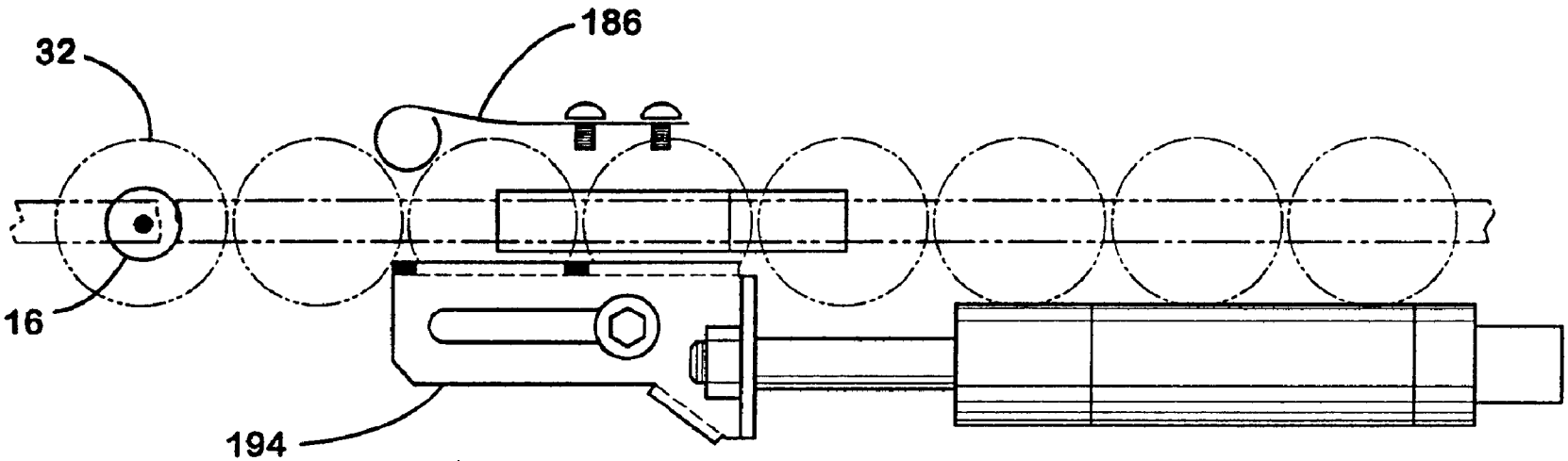
FIGS. 26*a* and 26*b* are a schematic plan view and schematic side elevational view, respectively, of the washer feed mechanism, showing the washer locator, retainer, and washer pusher mechanisms.
Figure 26B:
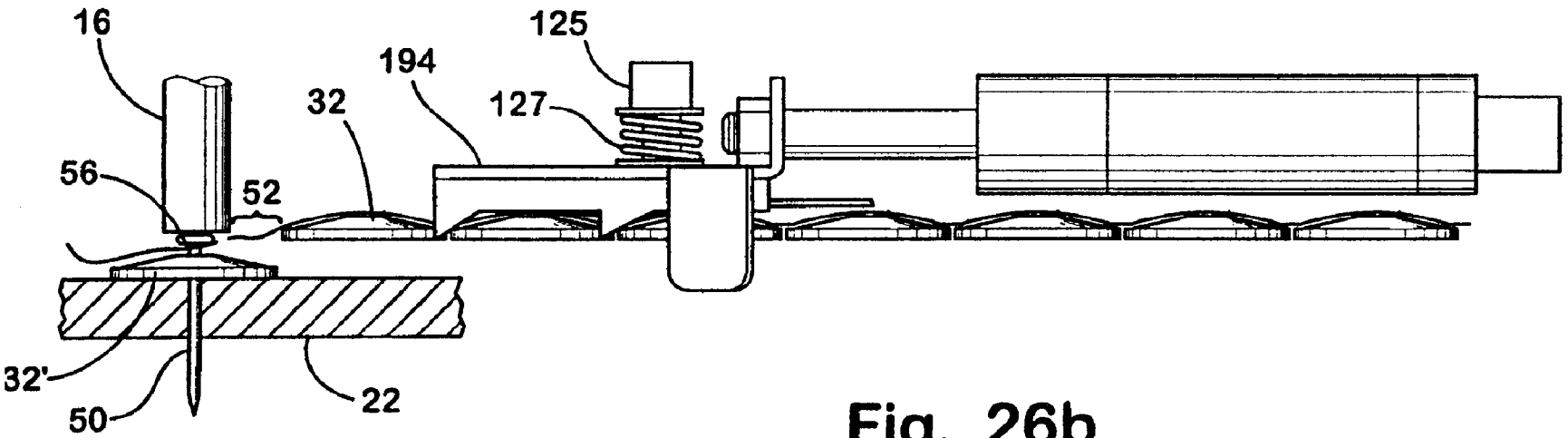
Figure 27:
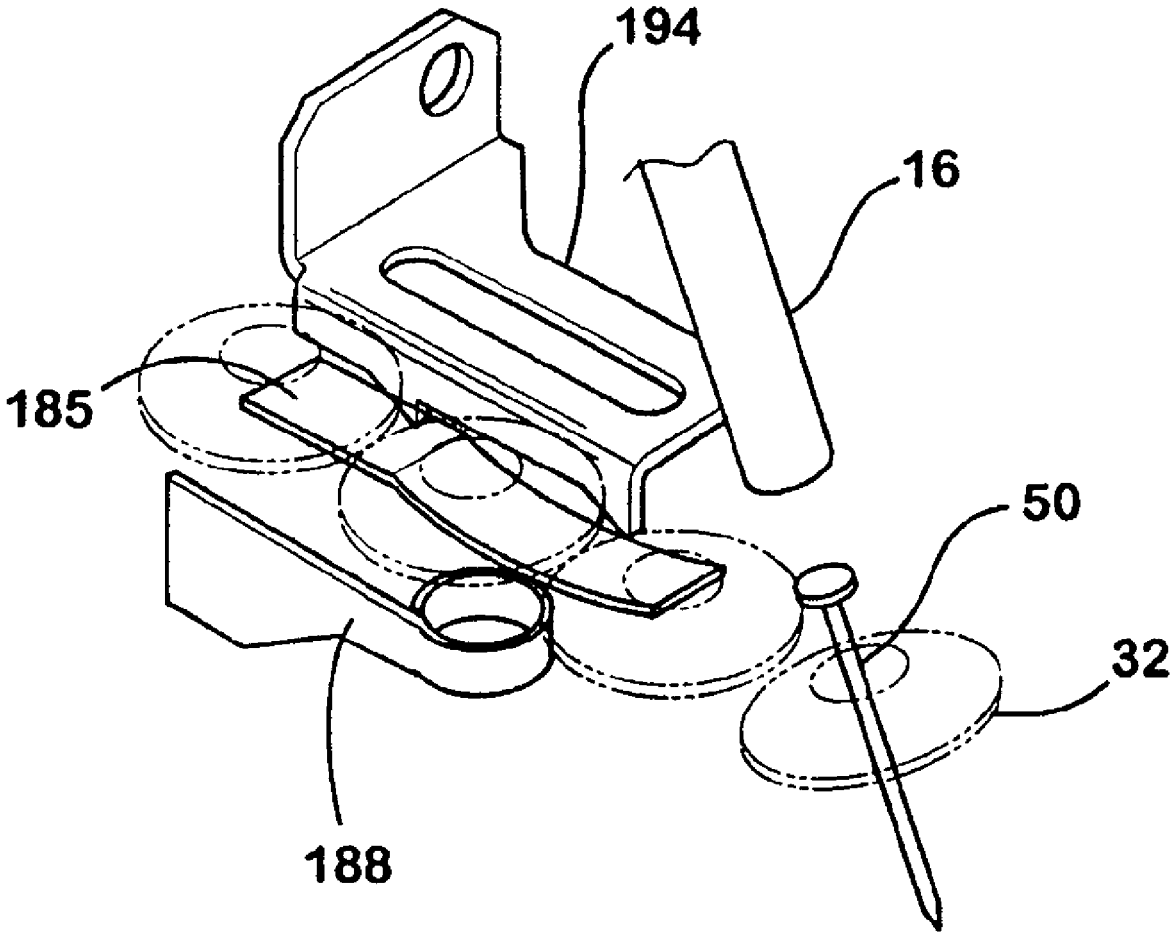
FIG. 27 is a perspective view showing the washer pusher, washer retainer, and washer locator mechanisms of FIG. 17.
Figure 28:
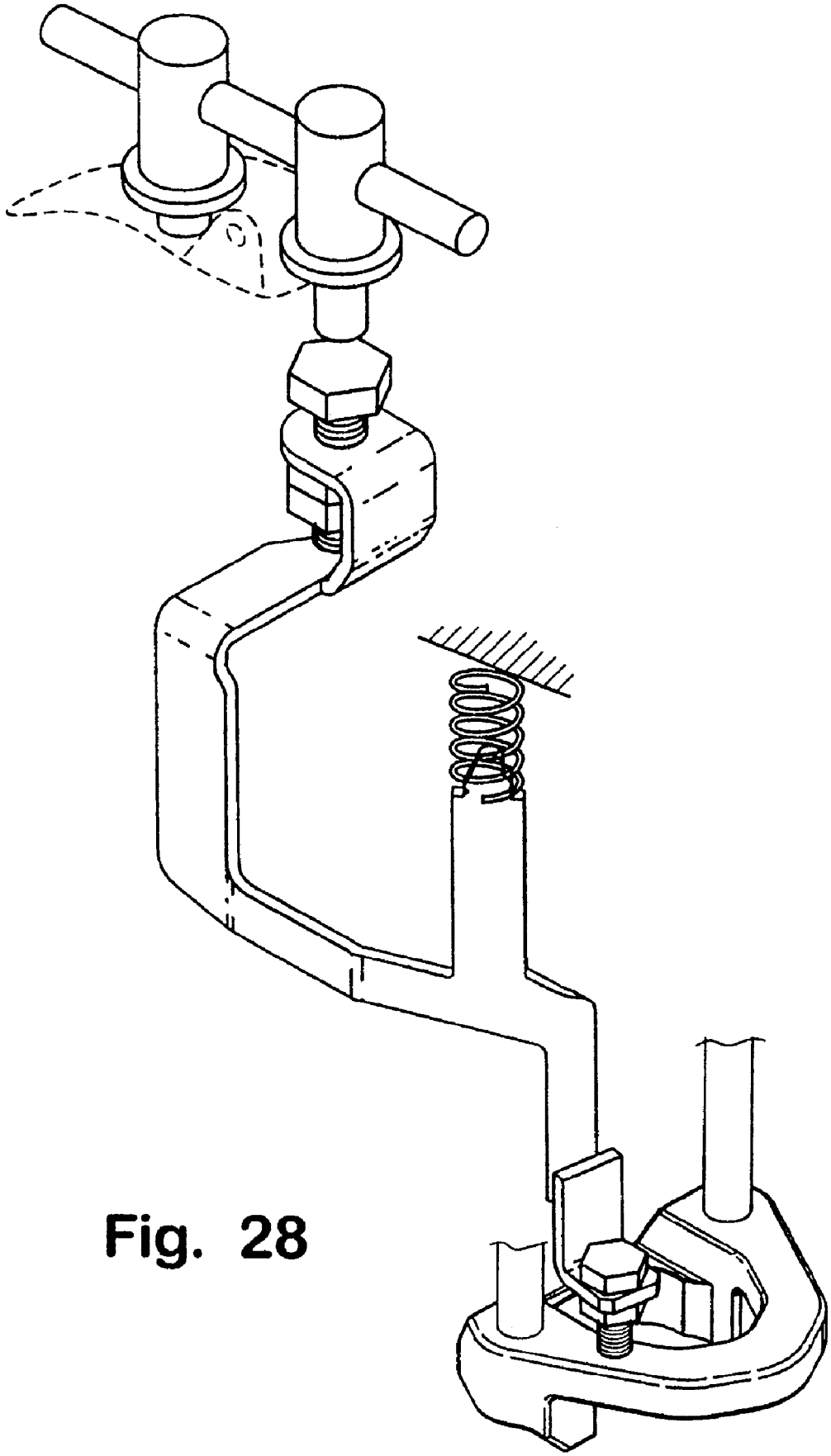
FIG. 28 is a schematic view showing the safety valve mechanism of the embodiment of FIG. 17.
Figure 29A:
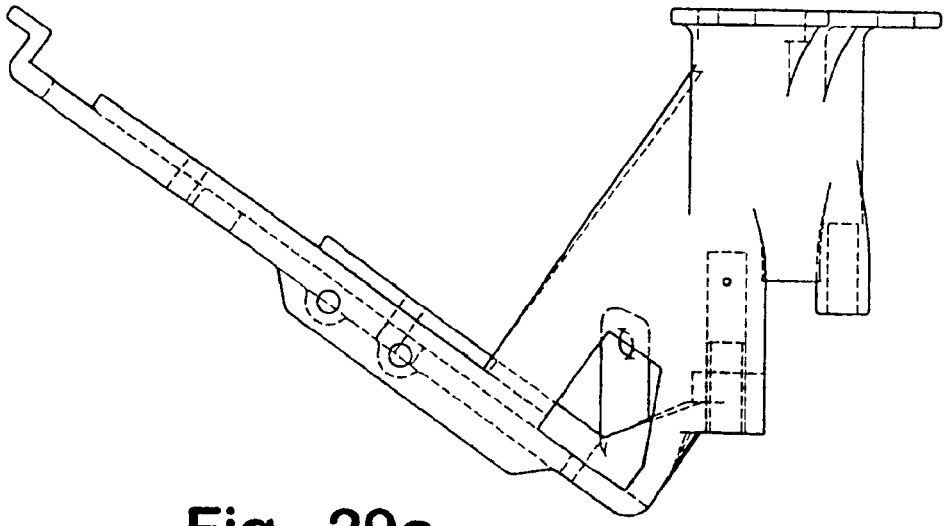
FIG. 29*a* is a side elevational view of the slide track mechanism of the embodiment of FIG. 17.
Figure 29B:
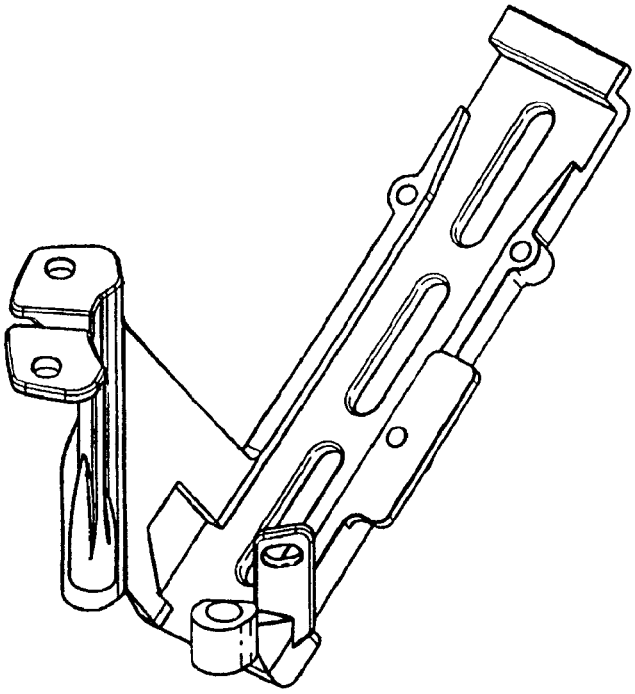
FIGS. 29*b* and 29*c* are perspective views of the slide track mechanism taken from a position above and a position below the track mechanisms.
Figure 29C:
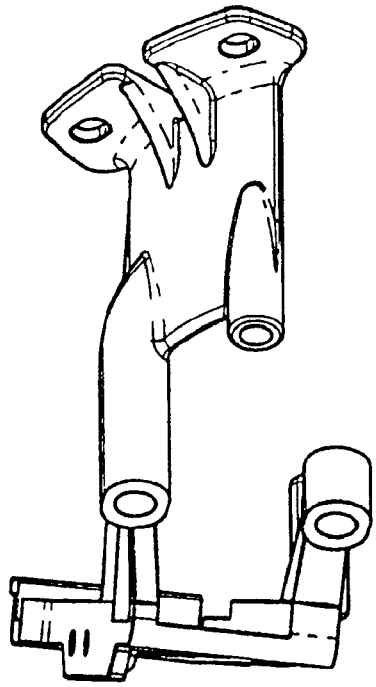
Figure 30:
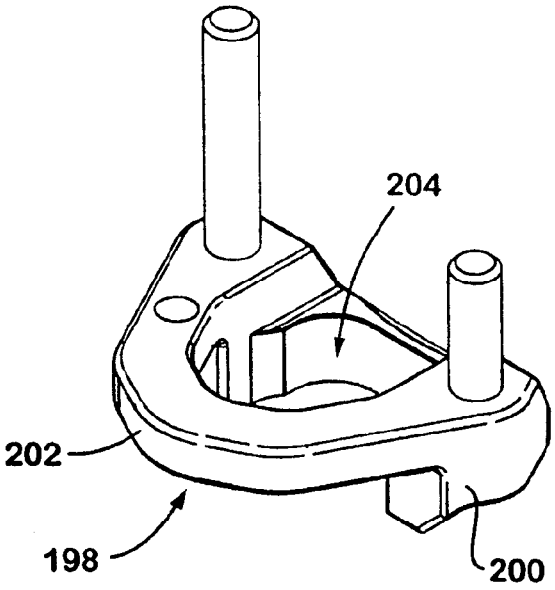
FIG. 30 is a perspective view of the foot mechanism of the embodiment of FIG. 17.

Referring to FIG. 17, reel holder 152 is formed in two side sections 156 and 158, which are bolted together. An interior arcuate partition 160 is spaced away from an outer wall 162 that runs along the outer edge of the reel holder, leaving a washer passageway 164 for passage of a strip of washers therethrough. Washer passageway 164 curves outwardly at a terminal end so as to direct washers outwardly through end 166 of the housing in a direction toward the inlet of slide track 168, which is attached to the reel holder in the same manner as described above. A gently curved flange 170 is formed at an upper end of arcuate member 160 and forms the inlet of the washer passageway 164. It is important that the inlet be curved as shown so that washers passing from the reel over member 170 will not be forced to bend too sharply around the corner at the inlet. If they are forced to bend too sharply, the washers can peel off of the tape.

The reel holder 152 is securely attached to the nail gun by means of a bracket 172 which has openings in an upper surface that are bolted downwardly on the top of the nail gun. The reel holder can also have a reinforcing arm attaching the side of the reel holder to the handle of the gun. However, this reinforcing arm is generally not necessary in this embodiment.

As stated above, washers are mounted on a spool 205 formed of cardboard or other suitable material, having circular plates on each side of a cylindrical core connecting the plates. The spool fits loosely into the reel holder and washers are fed downwardly from curved flange 170 at the inlet of the washer passage to outlet 166 of the washer passageway. By eliminating a spindle on which the reel is mounted, this reduces rotational friction between the reel and the reel holder, thus facilitating the feeding of washers to the nail gun. While the reel rests loosely in the cavity in the reel holder, tabs 176 positioned adjacent the outer edge of the reel holder restrain the reel from falling out of the open side of the reel holder. The flexible sides of the reel can be pinched together to insert the reel into the cavity and to remove the reel from the cavity, but the tabs are generally sufficient to hold the reel in the cavity during use.

Figure 36:
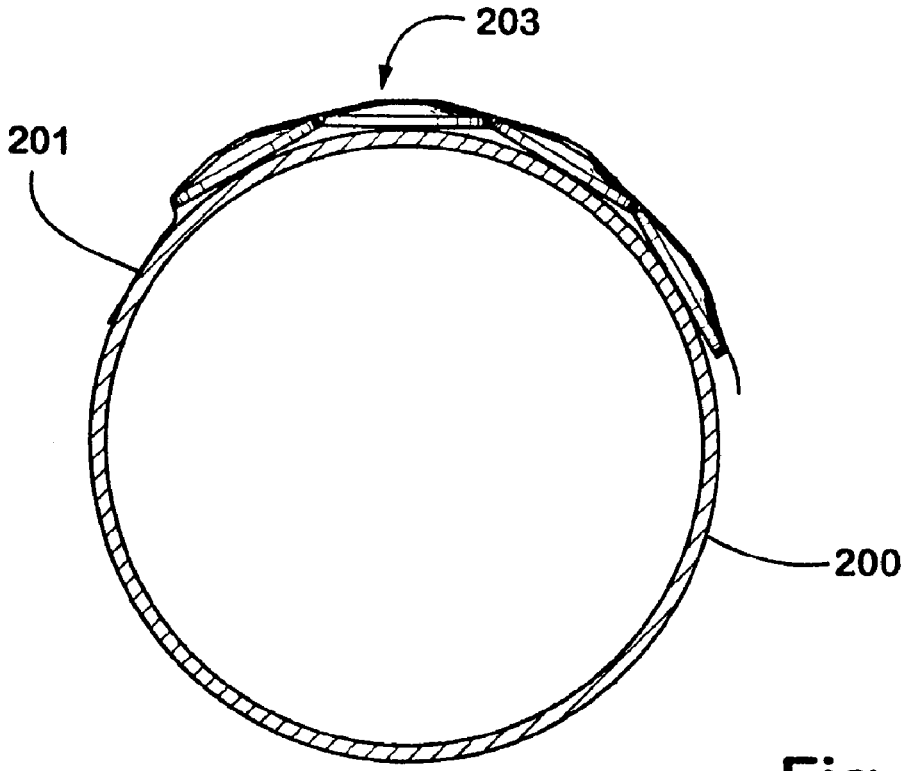
FIG. 36 is a cross sectional view of the core of a reel showing the manner in which a strip of washers is attached to the core.
Figure 37:
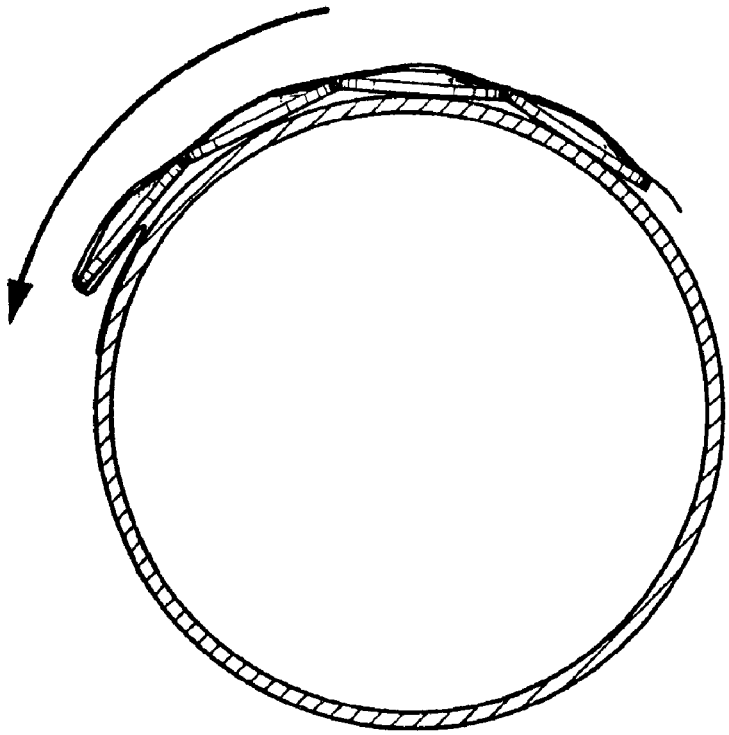
FIG. 37 is a view like FIG. 36 showing the manner in which the strip of washers is released from the core by back spinning the core.

In the present invention, it is desirable that the coil of washers be able to rotate freely on the reel and not require that the reel itself rotate. Thus, if the reel becomes wet or otherwise sticks in the reel holder the washers will still be free to rotate on the reel and be dispensed with minimum of pulling force. This construction is accomplished by mounting the washers on the reel by a process called back spinning. First, to wind the strip of washers on the reel a piece of adhesive tape at one end of the strip 203 of washers is attached to the core 205 of the reel and then the reel is rotated until the washers are wound on the reel (FIG. 35). When the reel is full, the reel is then rotated in the opposite direction, while holding the washers firmly in place. This causes the piece of tape attached to the core of the reel to be peeled from the reel and turned back into contact with the last washer (FIG. 36). At this point, the coil of washers is no longer attached to the reel and is free to rotate on the reel even if the reel is held in a fixed position.

The slide mechanism 168 of the embodiment of FIG. 17 is similar to the slide mechanism of the prior embodiment, with some modifications. First, the retainer is of somewhat different construction than the retainer of the prior embodiment. Retainer 180 includes a retainer spring 182 mounted by two screws 184 on the top of the retainer. The retainer spring has a downwardly arced belly portion 185 that is shaped so that it resiliently slides over the washers as they pass under the retainer but also fits between adjacent washers and holds the adjacent edges of the washers downwardly on the track. This prevents the washers from riding over each other as the washer pusher pushes the washers into position for insertion by the nail driver.

This embodiment of the invention also includes a washer locator or indexing spring 186 of somewhat different shape than the indexing spring of the prior embodiment. In this embodiment, indexing spring 186 includes a resilient flat portion 187 and a circular end portion 188 that extends inwardly into an opening 190 in the mounting bracket 192 of the washer feeder mechanism. The circular end portion of the spring fits between adjacent washers and holds them in a proper position until they are to be pushed into alignment with the nail driver. The indexing spring is deflected out of the way when the washer pusher advances the washers in the mechanism, while the retaining spring holds the washers down on the track.

In the embodiment disclosed in FIG. 17, an additional feature is incorporated into the washer pusher (also called a picker). Washer pusher 194, as in the prior embodiments, includes two teeth that push two washers into position. As before, the front edges of the teeth are vertical, whereas the back edges of the teeth are beveled upwardly, so that when the teeth are moved forwardly, they push the washers forwardly, whereas when the teeth are moved backwardly, the cam surfaces on the back of the teeth cause the teeth to ride up and over the washers. The resilient attachment mechanism holding the washer pusher to the track permits the washer pusher to pivot or rock upwardly so that the teeth can ride over the washers when the washer pusher is retracted. This embodiment of the washer pusher also includes an angled flange 196 that extends downwardly from an outer edge of the washer pusher at a skewed angle with respect to the axis of movement of the washers. When this flange is pressed manually from the outside of the flange, the pressure on the flange causes the washer pusher to be simultaneously rocked upwardly and moved rearwardly. Thus, when the flange is pressed, the teeth on the washer pusher lift upwardly and the flange moves rearwardly until the teeth are lowered into actuating position behind the next washers. Manual manipulation of the flange is necessary when the washers are loaded into the machine.

Figure 33B:
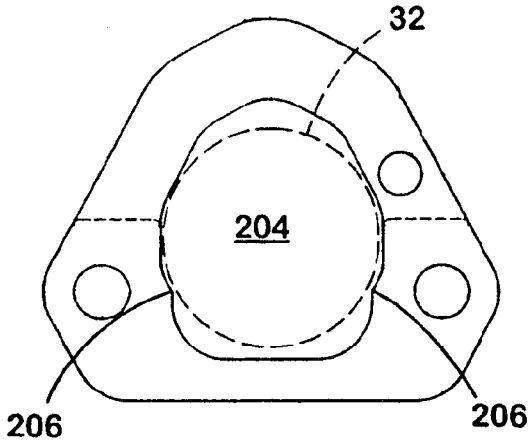
FIGS. 33*a* and 33*b* are plan views of the foot mechanism of FIG. 30 showing the position of a washer with the foot mechanism in its lowered and raised positions in FIGS. 33*a* and 33*b* respectively.
Figure 33A:
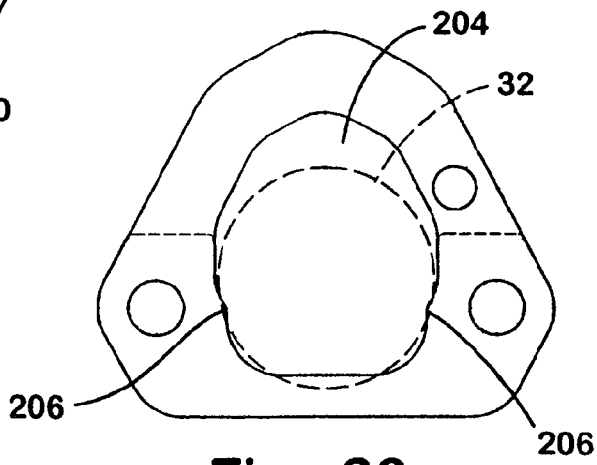
Figure 31:
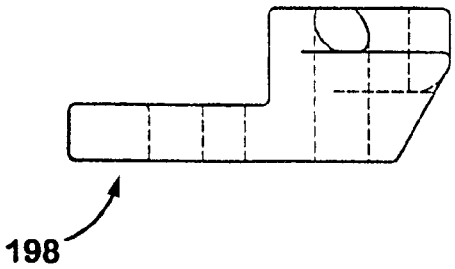
FIG. 31 is a side elevational view of the foot mechanism of FIG. 30.
Figure 32:
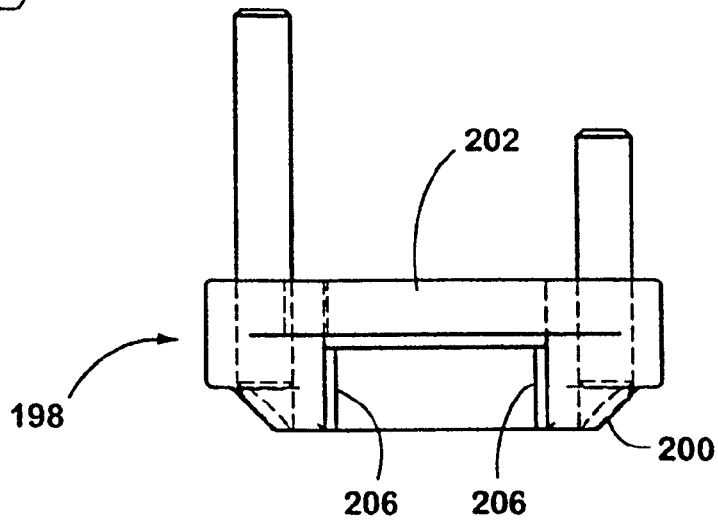
FIG. 32 is a front elevational view of the foot mechanism of FIG. 30

The embodiment of FIG. 17 also includes an improved foot construction, as shown in FIGS. 30-33*b*. In this embodiment, foot 198 includes a lower member 200 and an upper bar 202, as in the prior embodiment. These members surround and define an opening 204 through which the nail driver operates. The interior configuration of the opening is designed to properly position the washers and to urge the washers to remain in a generally horizontal position in line with the driven nail. In order to hold the washer in line with the nail driver in a generally horizontal position, a pair of ridges 206 are positioned adjacent an inner side of member 202. These ridges are spaced far enough apart so that they support an edge of each washer as it is inserted into alignment with the nail driver (FIG. 33*a*). This prevents the washer from hanging down at a sharply skewed angle so that it will not be in line with the nail driver. Because the foot is positioned horizontally to the substrate, whereas the track is positioned at an angle with respect to the substrate, as the foot is moved upwardly in order to deactivate the safety valve, the ridges on the foot move closer to the track. When the foot moves upwardly to its completely retracted position, wherein the safety valve is deactuated, the ridges on the foot have moved inwardly so that they no longer engage the washer (FIG. 33*b*). Thus, when the nail is thereafter driven downwardly, the ridges on the foot will not restrain the washer from moving vertically downwardly into contact with the substrate. This is significant particularly when the apparatus is used in a very cold condition, wherein the washers may be cold enough to break if they are restrained from free movement into the substrate.

The present invention provides a simple and economical way to automatically feed washers so that they are inserted on each nail as the nail is driven into a substrate by an automatic nail gun in a reliable and efficient manner.

We claim:

1. A washer feeding fastener driver comprising:

a fastener driver that drives fasteners through a penetration position:

a washer storage container that stores an elongate strip of sequentially connected washers, the washers joined in closely adjacent edge-to-edge positional relationship, the washer storage container joined with the fastener driver;

a washer feeding mechanism, joined with the fastener driver, that serially feeds the strip so that the washers sequentially move into the penetration position where a leading washer of the strip is in alignment with a fastener being driven by the fastener driver, the feeding mechanism being synchronized with the fastener driver such that the leading washer is placed at the penetration position in line with the fastener before the fastener is driven by the fastener driver, the washer feeding mechanism including:

a track extending between the washer storage container and the penetration position, where the leading washer is in alignment with the fastener being driven by the fastener driver, a first resilient member positioned adjacent the track, the first resilient member engaging at least one washer in the strip to urge the at least one washer against said track to temporarily position the strip in a fixed position, a second resilient member engaging an edge of at least one washer to prevent the washer from moving rearwardly along the track away from the fastener driver, and a pusher that moves the washers forwardly relative to the track to move the leading washer into the penetration position, the pusher being distal and separate from the first resilient member and the second resilient member, the pusher moving relative to and independently from the first resilient member and the second resilient member as the pusher moves the washers relative to the track;

wherein the washers are interconnected by a breakable linkage which is at least one of broken and cut when a fastener is driven through the leading washer in a penetrating manner and the washer is driven into contact with a substrate surface being fastened by the action of the fastener driver.

2. The washer feeding fastener driver of claim 1 wherein the breakable linkage is at least one of a strip of tape and a connector disposed between adjacent washers in the strip.

3. The washer feeding fastener driver of claim 1 wherein the first resilient member is joined with the second resilient member, and wherein the first and second resilient members are joined with the track.

4. The washer feeding fastener driver of claim 1 wherein the first resilient member includes an elongate arm extending substantially parallel to the track, the elongate arm joined with the track, the elongate arm terminating at a free front end adjacent the fastener driver, the free front end projecting upwardly relative to the track.

5. The washer feeding fastener driver of claim 4 wherein the track defines at least one hole, wherein the second resilient member projects at least partially through the at least one hole.

6. A washer feeding fastener driver comprising:

a fastener driver that drives fasteners, one at a time, through a driving zone;

a container that stores at least a portion of an elongate strip of sequentially connected washers, the strip including a leading washer positioned in the driving zone, and a succeeding washer immediately adjacent and upstream of the leading washer, the succeeding washer including an upper surface, a front edge and a rearward edge, the front edge joined with the leading washer and a rearward edge distal from the leading washer;

a track positioned between the container and the fastener driver, the track extending toward the driving zone and providing a support along which the elongate strip can move in a direction toward the driving zone;

a washer feeder cooperating with the strip to serially and intermittently feed the strip so that the washers sequentially and intermittently move along the track from the container into the driving zone in a manner that is synchronized with the fastener driver driving fasteners so that the leading washer is penetrated by a driven fastener and detached from the succeeding washer; and a first member joined with a second member, the first member including an arm extending above the track adjacent the upper surface of the succeeding washer to maintain the succeeding washer in engagement with the track, the second member positioned adjacent the rearward edge of the succeeding washer to engage the rearward edge of the succeeding washer and prevent the succeeding washer from moving rearwardly away from the driving zone;

wherein the washer feeder moves independently from, and is also distal from, the first member and the second member.

7. The washer feeding fastener driver of claim 6 wherein the washer feeder engages the rearward edge of the succeeding washer to move the succeeding washer toward the driving zone.

8. The washer feeding fastener driver of claim 6 wherein the first member is resiliently biased toward the track for engagement with a washer on the track.

9. The washer feeding fastener driver of claim 6 wherein the arm is elongate in a lengthwise direction of the track, wherein the arm is spaced upwardly from the track to confine the strip upstream of the leading washer between the arm and the track.

10. The washer feeding fastener driver of claim 6 wherein the arm of the first member includes an upwardly turned free end which extends away from the track.

11. The washer feeding fastener driver of claim 6 wherein the arm includes a front end, wherein the arm includes a rear end, distal and rearward from the front end, the rear end joined with the track, wherein the front end is angled upwardly relative to and extends away from the track.

12. The washer feeding fastener driver of claim 6 wherein the washer feeder includes a drive cylinder pivotally mounted relative to the track.

* * * * *

UNITED STATES PATENT AND TRADEMARK OFFICE

CERTIFICATE OF CORRECTION

PATENT NO. : 7,344,058 B2
APPLICATION NO. : 11/425399
DATED : March 18, 2008
INVENTOR(S) : Bruins et al.

It is certified that error appears in the above-identified patent and that said Letters Patent is hereby corrected as shown below:

Title page, item
(60) Related U.S. Application Data, Line 3:
"09/380,371" should be --09/380,871--

(57) Abstract, Line 7:
"in" should be --gun--

(57) Abstract, Line 10:
"whet" should be --when--

Signed and Sealed this

Seventh Day of October, 2008

JON W. DUDAS
*Director of the United States Patent and Trademark Office*